US010538922B2

(12) United States Patent
Pervan

(10) Patent No.: US 10,538,922 B2
(45) Date of Patent: Jan. 21, 2020

(54) MECHANICAL LOCKING SYSTEM FOR FLOOR PANELS

(71) Applicant: Ceraloc Innovation AB, Viken (SE)

(72) Inventor: Darko Pervan, Viken (SE)

(73) Assignee: CERALOC INNOVATION AB, Viken (SE)

( * ) Notice: Subject to any disclaimer, the term of this patent is extended or adjusted under 35 U.S.C. 154(b) by 0 days.

(21) Appl. No.: 15/541,909

(22) PCT Filed: Nov. 5, 2016

(86) PCT No.: PCT/SE2016/050019
§ 371 (c)(1),
(2) Date: Jul. 6, 2017

(87) PCT Pub. No.: WO2016/114712
PCT Pub. Date: Jul. 21, 2016

(65) Prior Publication Data
US 2018/0002933 A1 Jan. 4, 2018

(30) Foreign Application Priority Data
Jan. 16, 2015 (SE) ..... 1550033

(51) Int. Cl.
*E04F 15/02* (2006.01)
*E04F 15/10* (2006.01)

(52) U.S. Cl.
CPC ..... *E04F 15/02038* (2013.01); *E04F 15/102* (2013.01); *E04F 2201/0123* (2013.01); *E04F 2201/0138* (2013.01); *E04F 2201/0146* (2013.01); *E04F 2201/021* (2013.01); *E04F 2201/041* (2013.01)

(58) Field of Classification Search
CPC ..... E04F 15/041; E04F 15/02038; E04F 2201/0123; E04F 2201/0146; E04F 2201/041
See application file for complete search history.

(56) References Cited

U.S. PATENT DOCUMENTS 3,077,703 A 2/1963 Bergstrom
3,619,961 A 11/1971 Sterrett et al.
(Continued)

FOREIGN PATENT DOCUMENTS

CA 2456513 A1 2/2003
CN 201 261 936 Y 6/2009
(Continued)

OTHER PUBLICATIONS

U.S. Appl. No. 15/923,475, Christian Boo and Stefan Stigert, filed Mar. 16, 2018.
(Continued)

*Primary Examiner* — Christine T Cajilig
(74) *Attorney, Agent, or Firm* — Buchanan Ingersoll & Rooney P.C.

(57) ABSTRACT

Floor panels are shown, which are provided with a mechanical locking system that may be locked with a vertical displacement of a first panel against a second panel. The locking system includes a first rigid and a second flexible joint edge section with different locking functions. The first edge section provides a horizontal locking and the second section provides a vertical locking.

8 Claims, 28 Drawing Sheets

(56) References Cited

U.S. PATENT DOCUMENTS

| | | | |
|---|---|---|---|
| 3,720,027 | A | 3/1973 | Christensen |
| 3,889,736 | A | 6/1975 | Firks |
| 3,998,015 | A | 12/1976 | Scott et al. |
| 4,123,885 | A | 11/1978 | Scott |
| 4,426,820 | A | 1/1984 | Terbrack |
| 4,698,945 | A | 10/1987 | Munn |
| 4,953,341 | A | 9/1990 | Joos |
| 5,182,892 | A | 2/1993 | Chase |
| 5,274,979 | A | 1/1994 | Tsai |
| 5,616,389 | A | 4/1997 | Blatz |
| 6,006,486 | A | 12/1999 | Moriau et al. |
| 6,385,936 | B1 | 5/2002 | Schneider |
| 6,490,836 | B1 | 12/2002 | Moriau et al. |
| 6,505,452 | B1 | 1/2003 | Hannig |
| 6,715,253 | B2 | 4/2004 | Pervan |
| 6,769,219 | B2 | 8/2004 | Schwitte et al. |
| 6,772,568 | B2 | 8/2004 | Thiers et al. |
| 6,808,777 | B2 | 10/2004 | Andersson |
| 6,880,307 | B2 | 4/2005 | Schwitte et al. |
| 6,918,220 | B2 | 7/2005 | Pervan |
| 6,968,664 | B2 | 11/2005 | Thiers |
| 7,051,486 | B2 | 5/2006 | Pervan |
| 7,081,300 | B2 | 7/2006 | Laurence |
| 7,121,058 | B2 | 10/2006 | Palsson |
| 7,127,860 | B2 | 10/2006 | Pervan et al. |
| 7,454,875 | B2 | 11/2008 | Pervan et al. |
| 7,550,192 | B2 | 6/2009 | Dempsey |
| 7,568,322 | B2 | 8/2009 | Pervan |
| 7,584,583 | B2 | 9/2009 | Bergelin et al. |
| 7,617,651 | B2 | 11/2009 | Grafenauer |
| 7,634,884 | B2 | 12/2009 | Pervan |
| 7,637,068 | B2 | 12/2009 | Pervan |
| 7,677,005 | B2 | 3/2010 | Pervan |
| 7,721,503 | B2 | 5/2010 | Pervan et al. |
| 7,757,452 | B2 | 7/2010 | Pervan |
| 7,793,471 | B2 | 9/2010 | Hill |
| 7,802,411 | B2 | 9/2010 | Pervan |
| 7,832,161 | B2 | 11/2010 | Ligabue |
| 7,841,144 | B2 | 11/2010 | Pervan et al. |
| 7,841,145 | B2 | 11/2010 | Pervan et al. |
| 7,841,150 | B2 | 11/2010 | Pervan |
| 7,861,482 | B2 | 1/2011 | Pervan et al. |
| 7,866,110 | B2 | 1/2011 | Pervan |
| 7,874,118 | B2 | 1/2011 | Schitter |
| 7,886,497 | B2 | 2/2011 | Pervan |
| 7,896,571 | B1 | 3/2011 | Hannig et al. |
| 7,908,815 | B2 | 3/2011 | Pervan et al. |
| 7,908,816 | B2 | 3/2011 | Grafenauer et al. |
| 7,930,862 | B2 | 4/2011 | Bergelin et al. |
| 7,980,041 | B2 | 7/2011 | Pervan |
| 8,011,163 | B2 | 9/2011 | Bazzano |
| 8,033,074 | B2 | 10/2011 | Pervan |
| 8,042,311 | B2 | 10/2011 | Pervan |
| 8,061,104 | B2 | 11/2011 | Pervan |
| 8,079,196 | B2 | 12/2011 | Pervan |
| 8,099,924 | B2 | 1/2012 | Braun |
| 8,112,967 | B2 | 2/2012 | Pervan et al. |
| 8,122,670 | B2 | 2/2012 | Matthee |
| 8,171,692 | B2 | 5/2012 | Pervan |
| 8,181,416 | B2 | 5/2012 | Pervan et al. |
| 8,234,830 | B2 | 8/2012 | Pervan et al. |
| 8,266,849 | B2 | 9/2012 | Bravo et al. |
| 8,302,361 | B2 | 11/2012 | Braun et al. |
| 8,341,914 | B2 | 1/2013 | Pervan et al. |
| 8,341,915 | B2 | 1/2013 | Pervan et al. |
| 8,353,140 | B2 | 1/2013 | Pervan et al. |
| 8,359,805 | B2 | 1/2013 | Pervan et al. |
| 8,381,477 | B2 | 2/2013 | Pervan et al. |
| 8,387,327 | B2 | 3/2013 | Pervan |
| 8,448,402 | B2 | 5/2013 | Pervan et al. |
| 8,499,521 | B2 | 8/2013 | Pervan et al. |
| 8,505,257 | B2 | 8/2013 | Boo et al. |
| 8,511,040 | B2 | 8/2013 | Braun et al. |
| 8,528,289 | B2 | 9/2013 | Pervan et al. |
| 8,544,230 | B2 | 10/2013 | Pervan |
| 8,544,231 | B2 | 10/2013 | Hannig |
| 8,544,234 | B2 | 10/2013 | Pervan et al. |
| 8,572,922 | B2 | 11/2013 | Pervan |
| 8,596,013 | B2 | 12/2013 | Boo |
| 8,627,862 | B2 | 1/2014 | Pervan et al. |
| 8,640,424 | B2 | 2/2014 | Pervan et al. |
| 8,650,826 | B2 | 2/2014 | Pervan et al. |
| 8,677,714 | B2 | 3/2014 | Pervan |
| 8,689,512 | B2 | 4/2014 | Pervan |
| 8,707,650 | B2 | 4/2014 | Pervan |
| 8,713,886 | B2 | 5/2014 | Boo et al. |
| 8,733,065 | B2 | 5/2014 | Pervan |
| 8,733,410 | B2 | 5/2014 | Pervan |
| 8,763,341 | B2 | 7/2014 | Pervan |
| 8,769,905 | B2 | 7/2014 | Pervan |
| 8,776,473 | B2 | 7/2014 | Pervan et al. |
| 8,806,832 | B2 | 8/2014 | Kell |
| 8,844,236 | B2 | 9/2014 | Pervan et al. |
| 8,857,126 | B2 | 10/2014 | Pervan et al. |
| 8,863,473 | B2 | 10/2014 | Weber |
| 8,869,485 | B2 | 10/2014 | Pervan |
| 8,898,988 | B2 | 12/2014 | Pervan |
| 8,925,264 | B2 | 1/2015 | Thrush et al. |
| 8,925,274 | B2 | 1/2015 | Pervan et al. |
| 8,959,866 | B2 | 2/2015 | Pervan |
| 8,973,331 | B2 | 3/2015 | Boo |
| 9,003,741 | B2 | 4/2015 | D'Agostino |
| 9,027,306 | B2 | 5/2015 | Pervan |
| 9,051,738 | B2 | 6/2015 | Pervan et al. |
| 9,068,360 | B2 | 6/2015 | Pervan |
| 9,091,077 | B2 | 7/2015 | Boo |
| 9,103,126 | B2 | 8/2015 | Kell |
| 9,194,134 | B2 | 11/2015 | Nygren et al. |
| 9,212,492 | B2 | 12/2015 | Pervan et al. |
| 9,216,541 | B2 | 12/2015 | Boo et al. |
| 9,236,917 | B2 | 1/2016 | Jeong et al. |
| 9,260,870 | B2 | 2/2016 | Vermeulen |
| 9,284,737 | B2 | 3/2016 | Pervan et al. |
| 9,309,679 | B2 | 4/2016 | Pervan et al. |
| 9,316,002 | B2 | 4/2016 | Boo |
| 9,340,974 | B2 | 5/2016 | Pervan et al. |
| 9,347,469 | B2 | 5/2016 | Pervan |
| 9,359,774 | B2 | 6/2016 | Pervan |
| 9,366,036 | B2 | 6/2016 | Pervan |
| 9,376,821 | B2 | 6/2016 | Pervan |
| 9,382,716 | B2 | 7/2016 | Pervan et al. |
| 9,388,584 | B2 | 7/2016 | Pervan et al. |
| 9,428,919 | B2 | 8/2016 | Pervan et al. |
| 9,453,347 | B2 | 9/2016 | Pervan |
| 9,458,634 | B2 | 10/2016 | Derelov |
| 9,482,012 | B2 | 11/2016 | Nygren et al. |
| 9,540,826 | B2 | 1/2017 | Pervan et al. |
| 9,663,940 | B2 | 5/2017 | Boo |
| 9,725,912 | B2 | 8/2017 | Pervan |
| 9,771,723 | B2 | 9/2017 | Pervan |
| 9,777,487 | B2 | 10/2017 | Pervan et al. |
| 9,803,374 | B2 | 10/2017 | Pervan |
| 9,803,375 | B2 | 10/2017 | Pervan |
| 9,856,656 | B2 | 1/2018 | Pervan |
| 9,856,657 | B2 | 1/2018 | Thiers |
| 9,874,027 | B2 | 1/2018 | Pervan |
| 9,945,130 | B2 | 4/2018 | Nygren et al. |
| 9,951,526 | B2 | 4/2018 | Boo et al. |
| 10,000,935 | B2 | 6/2018 | Kell |
| 10,006,210 | B2 | 6/2018 | Pervan et al. |
| 10,017,948 | B2 | 7/2018 | Boo |
| 10,113,319 | B2 | 10/2018 | Pervan |
| 10,125,488 | B2 | 11/2018 | Boo |
| 10,138,636 | B2 | 11/2018 | Pervan |
| 10,161,139 | B2 | 12/2018 | Pervan |
| 10,180,005 | B2 | 1/2019 | Pervan et al. |
| 10,214,915 | B2 | 2/2019 | Pervan et al. |
| 10,214,917 | B2 | 2/2019 | Pervan et al. |
| 10,240,348 | B2 | 3/2019 | Pervan et al. |
| 10,240,349 | B2 | 3/2019 | Pervan et al. |
| 10,246,883 | B2 | 4/2019 | Derelöv |
| 10,352,049 | B2 | 7/2019 | Boo |
| 10,358,830 | B2 | 7/2019 | Pervan |
| 10,378,217 | B2 | 8/2019 | Pervan |

(56) References Cited

U.S. PATENT DOCUMENTS

2002/0112433 A1 8/2002 Pervan
2003/0024199 A1* 2/2003 Pervan ..... E04F 15/04 52/589.1
2003/0084636 A1 5/2003 Pervan
2003/0101681 A1 6/2003 Tychsen
2004/0016196 A1 1/2004 Pervan
2004/0068954 A1 4/2004 Martensson
2004/0128934 A1 7/2004 Hecht
2004/0139678 A1 7/2004 Pervan
2004/0182036 A1 9/2004 Sjoberg et al.
2004/0250492 A1 12/2004 Becker
2005/0160694 A1 7/2005 Pervan
2005/0210810 A1 9/2005 Pervan
2006/0070333 A1 4/2006 Pervan
2006/0101769 A1 5/2006 Pervan
2006/0101773 A1 5/2006 Turner et al.
2006/0156670 A1 7/2006 Knauseder
2006/0236642 A1 10/2006 Pervan
2006/0260254 A1 11/2006 Pervan et al.
2007/0006543 A1 1/2007 Engström
2007/0028547 A1 2/2007 Grafenauer et al.
2007/0062148 A1 3/2007 Nienhuis et al.
2007/0193178 A1 8/2007 Groeke et al.
2008/0000186 A1 1/2008 Pervan et al.
2008/0000187 A1 1/2008 Pervan et al.
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0066415 A1 3/2008 Pervan
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan
2008/0155930 A1 7/2008 Pervan et al.
2008/0216434 A1 9/2008 Pervan
2008/0216920 A1 9/2008 Pervan
2008/0236088 A1 10/2008 Hannig
2008/0295432 A1 12/2008 Pervan et al.
2009/0019808 A1 1/2009 Palsson et al.
2009/0133353 A1 5/2009 Pervan et al.
2009/0193741 A1 8/2009 Capelle
2009/0193748 A1 8/2009 Boo et al.
2009/0193753 A1 8/2009 Schitter
2009/0249733 A1 10/2009 Moebus
2010/0031594 A1 2/2010 Liu et al.
2010/0037550 A1 2/2010 Braun
2010/0058590 A1 3/2010 Braun et al.
2010/0083603 A1 4/2010 Goodwin
2010/0218450 A1* 9/2010 Braun ..... E04F 15/02 52/588.1
2010/0257809 A1 10/2010 Thiers et al.
2010/0293879 A1 11/2010 Pervan et al.
2010/0300029 A1 12/2010 Braun et al.
2010/0300031 A1 12/2010 Pervan et al.
2010/0319290 A1 12/2010 Pervan
2010/0319291 A1 12/2010 Pervan et al.
2011/0011020 A1 1/2011 Shen
2011/0016822 A1 1/2011 Braun
2011/0023303 A1 2/2011 Pervan
2011/0030300 A1 2/2011 Liu
2011/0030303 A1 2/2011 Pervan et al.
2011/0041996 A1 2/2011 Pervan
2011/0056167 A1 3/2011 Nilsson et al.
2011/0088344 A1 4/2011 Pervan et al.
2011/0088345 A1 4/2011 Pervan
2011/0094178 A1 4/2011 Braun
2011/0131909 A1 6/2011 Hannig
2011/0154763 A1 6/2011 Bergelin et al.
2011/0167750 A1 7/2011 Pervan
2011/0167751 A1 7/2011 Engstrom
2011/0225922 A1 9/2011 Pervan et al.
2011/0252733 A1 10/2011 Pervan
2011/0258959 A1* 10/2011 Braun ..... E04F 15/02 52/588.1
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0067461 A1* 3/2012 Braun ..... E04F 15/02 144/371
2012/0096801 A1 4/2012 Cappelle
2012/0151865 A1 6/2012 Pervan et al.
2012/0174515 A1 7/2012 Pervan
2012/0174520 A1 7/2012 Pervan
2012/0180408 A1 7/2012 Harris et al.
2012/0192521 A1 8/2012 Schulte
2012/0279161 A1 11/2012 Håkansson et al.
2012/0317916 A1 12/2012 Oh
2013/0008117 A1 1/2013 Pervan
2013/0008127 A1 1/2013 Braun et al.
2013/0014463 A1 1/2013 Pervan
2013/0019555 A1 1/2013 Pervan
2013/0042562 A1 2/2013 Pervan
2013/0042563 A1 2/2013 Pervan
2013/0042564 A1 2/2013 Pervan et al.
2013/0042565 A1 2/2013 Pervan
2013/0047536 A1* 2/2013 Pervan ..... B26D 1/14 52/309.1
2013/0081349 A1 4/2013 Pervan et al.
2013/0111845 A1 5/2013 Pervan
2013/0145708 A1 6/2013 Pervan
2013/0160391 A1 6/2013 Pervan et al.
2013/0167458 A1 7/2013 Cerny et al.
2013/0192158 A1* 8/2013 Cappelle ..... B32B 7/02 52/588.1
2013/0232905 A2 9/2013 Pervan
2013/0239508 A1 9/2013 Pervan et al.
2013/0247501 A1 9/2013 Thiers et al.
2013/0263454 A1 10/2013 Boo et al.
2013/0263547 A1 10/2013 Boo
2013/0318906 A1 12/2013 Pervan et al.
2013/0333182 A1 12/2013 Pervan
2014/0007539 A1 1/2014 Pervan et al.
2014/0020324 A1 1/2014 Pervan
2014/0033633 A1 2/2014 Kell
2014/0033634 A1 2/2014 Pervan
2014/0053497 A1 2/2014 Pervan et al.
2014/0059966 A1 3/2014 Boo
2014/0069043 A1 3/2014 Pervan
2014/0090335 A1 4/2014 Pervan et al.
2014/0109501 A1 4/2014 Pervan
2014/0109506 A1 4/2014 Pervan et al.
2014/0123586 A1 5/2014 Pervan et al.
2014/0190112 A1 7/2014 Pervan
2014/0208677 A1 7/2014 Pervan et al.
2014/0223852 A1 8/2014 Pervan
2014/0237931 A1 8/2014 Pervan
2014/0250813 A1 9/2014 Nygren et al.
2014/0260060 A1 9/2014 Pervan et al.
2014/0283477 A1 9/2014 Hannig
2014/0305065 A1 10/2014 Pervan
2014/0366476 A1 12/2014 Pervan
2014/0366477 A1 12/2014 Kell
2014/0373478 A2 12/2014 Pervan et al.
2014/0373480 A1 12/2014 Pervan et al.
2015/0000221 A1 1/2015 Boo
2015/0013260 A1 1/2015 Pervan
2015/0059281 A1 3/2015 Pervan
2015/0089896 A2 4/2015 Pervan et al.
2015/0121796 A1 5/2015 Pervan
2015/0152644 A1 6/2015 Boo
2015/0167318 A1 6/2015 Pervan
2015/0211239 A1 7/2015 Pervan
2015/0233125 A1 8/2015 Pervan et al.
2015/0267418 A1 9/2015 Vermeulen et al.
2015/0267419 A1 9/2015 Pervan
2015/0300029 A1 10/2015 Pervan
2015/0330088 A1 11/2015 Derelov
2015/0337537 A1 11/2015 Boo
2015/0368910 A1 12/2015 Kell
2016/0069088 A1 3/2016 Boo et al.

(56) References Cited

U.S. PATENT DOCUMENTS

| | | | |
|---|---|---|---|
| 2016/0076260 | A1 | 3/2016 | Pervan et al. |
| 2016/0153200 | A1 | 6/2016 | Pervan |
| 2016/0168866 | A1 | 6/2016 | Pervan et al. |
| 2016/0186426 | A1 | 6/2016 | Boo |
| 2016/0194884 | A1 | 7/2016 | Pervan et al. |
| 2016/0201336 | A1 | 7/2016 | Pervan |
| 2016/0251859 | A1 | 9/2016 | Pervan et al. |
| 2016/0251860 | A1 | 9/2016 | Pervan |
| 2016/0281368 | A1 | 9/2016 | Pervan et al. |
| 2016/0281370 | A1 | 9/2016 | Pervan et al. |
| 2016/0326751 | A1 | 11/2016 | Pervan |
| 2016/0340913 | A1 | 11/2016 | Derelöv |
| 2017/0037641 | A1 | 2/2017 | Nygren et al. |
| 2017/0081860 | A1 | 3/2017 | Boo |
| 2017/0254096 | A1 | 9/2017 | Pervan |
| 2017/0321433 | A1 | 11/2017 | Pervan et al. |
| 2017/0362834 | A1 | 12/2017 | Pervan et al. |
| 2018/0001509 | A1 | 1/2018 | Myllykangas et al. |
| 2018/0001510 | A1 | 1/2018 | Fransson |
| 2018/0001573 | A1 | 1/2018 | Blomgren et al. |
| 2018/0016783 | A1 | 1/2018 | Boo |
| 2018/0030737 | A1 | 2/2018 | Pervan |
| 2018/0030738 | A1 | 2/2018 | Pervan |
| 2018/0119431 | A1 | 5/2018 | Pervan et al. |
| 2018/0178406 | A1 | 6/2018 | Fransson et al. |
| 2019/0024387 | A1 | 1/2019 | Pervan |
| 2019/0048592 | A1 | 2/2019 | Boo |
| 2019/0048596 | A1 | 2/2019 | Pervan |
| 2019/0063076 | A1 | 2/2019 | Boo et al. |
| 2019/0093370 | A1 | 3/2019 | Pervan et al. |
| 2019/0093371 | A1 | 3/2019 | Pervan |
| 2019/0119928 | A1 | 4/2019 | Pervan et al. |
| 2019/0127989 | A1 | 5/2019 | Kell |
| 2019/0127990 | A1 | 5/2019 | Pervan et al. |
| 2019/0169859 | A1 | 6/2019 | Pervan et al. |
| 2019/0232473 | A1 | 8/2019 | Fransson et al. |

FOREIGN PATENT DOCUMENTS

| | | | |
|---|---|---|---|
| CN | 201665978 | U | 12/2010 |
| DE | 25 16 843 | A1 | 10/1976 |
| DE | 103 05 695 | A1 | 9/2004 |
| DE | 10 2004 001 363 | A1 | 8/2005 |
| DE | 10 2005 024 366 | A1 | 11/2006 |
| DE | 10 2007 020 271 | A1 | 8/2008 |
| DE | 10 2007 062 430 | B3 | 7/2009 |
| DE | 20 2007 018 935 | U1 | 10/2009 |
| DE | 10 2008 031 167 | A1 | 1/2010 |
| DE | 10 2009 048 050 | B3 | 1/2011 |
| DE | 20 2010 010 620 | U1 | 11/2011 |
| EP | 0 085 196 | A1 | 8/1983 |
| EP | 1 350 904 | A2 | 10/2003 |
| EP | 1 350 904 | A3 | 10/2003 |
| EP | 1 396 593 | A2 | 3/2004 |
| EP | 1 420 125 | A2 | 5/2004 |
| EP | 1 437 457 | A2 | 7/2004 |
| EP | 1 437 457 | A3 | 7/2004 |
| EP | 1 512 808 | A1 | 3/2005 |
| EP | 1 640 530 | A2 | 3/2006 |
| EP | 1 980 683 | A2 | 10/2008 |
| ES | 2 327 502 | T3 | 10/2009 |
| ES | 2 327 502 | T5 | 3/2013 |
| GB | 2 436 570 | A | 10/2007 |
| WO | WO 00/20705 | A1 | 4/2000 |
| WO | WO 00/47641 | A1 | 8/2000 |
| WO | WO 01/02669 | A1 | 1/2001 |
| WO | WO 01/02670 | A1 | 1/2001 |
| WO | WO 01/51732 | A1 | 7/2001 |
| WO | WO 01/51733 | A1 | 7/2001 |
| WO | WO 01/53628 | A1 | 7/2001 |
| WO | WO 01/75247 | A1 | 10/2001 |
| WO | WO 01/77461 | A1 | 10/2001 |
| WO | WO 01/88306 | A1 | 11/2001 |
| WO | WO 01/98603 | A2 | 12/2001 |
| WO | WO 01/98604 | A1 | 12/2001 |
| WO | WO 03/012224 | A1 | 2/2003 |
| WO | WO 03/025307 | A1 | 3/2003 |
| WO | WO 03/038210 | A1 | 5/2003 |
| WO | WO 03/089736 | A1 | 10/2003 |
| WO | WO 2004/016876 | A2 | 2/2004 |
| WO | WO 2004/053258 | A1 | 6/2004 |
| WO | WO 2004/085765 | A1 | 10/2004 |
| WO | WO 2005/003489 | A1 | 1/2005 |
| WO | WO 2006/043893 | A1 | 4/2006 |
| WO | WO 2007/015669 | A2 | 2/2007 |
| WO | WO 2007/015669 | A3 | 2/2007 |
| WO | WO 2007/079845 | A1 | 7/2007 |
| WO | WO 2007/141605 | A2 | 12/2007 |
| WO | WO 2008/004960 | A2 | 1/2008 |
| WO | WO 2008/004960 | A3 | 1/2008 |
| WO | WO 2008/004960 | A8 | 1/2008 |
| WO | WO 2008/116623 | A1 | 10/2008 |
| WO | WO 2009/033623 | A1 | 3/2009 |
| WO | WO 2009/080328 | A1 | 7/2009 |
| WO | WO 2009/116926 | A1 | 9/2009 |
| WO | WO 2010/006684 | A2 | 1/2010 |
| WO | WO 2010/006684 | A3 | 1/2010 |
| WO | WO 2010/015516 | A2 | 2/2010 |
| WO | WO 2010/015516 | A3 | 2/2010 |
| WO | WO 2010/081532 | A1 | 7/2010 |
| WO | WO 2010/086084 | A1 | 8/2010 |
| WO | WO 2010/087752 | A1 | 8/2010 |
| WO | WO 2010/100046 | A1 | 9/2010 |
| WO | WO 2011/001326 | A2 | 1/2011 |
| WO | WO 2011/038709 | A1 | 4/2011 |
| WO | WO 2012/084604 | A1 | 6/2012 |
| WO | WO 2013/009257 | A1 | 1/2013 |
| WO | WO 2013/030686 | A2 | 3/2013 |
| WO | WO 2013/032391 | A1 | 3/2013 |
| WO | WO 2013/151494 | A1 | 10/2013 |
| WO | WO 2013/191632 | A1 | 12/2013 |

OTHER PUBLICATIONS

U.S. Appl. No. 15/977,210, Richard William Kell, filed May 11, 2018.
US 2010/0037550 A1—WO 2009/033623 A1.
US 2010/0058590 A1—WO 2009/080328 A1.
US 2010/0300029 A1—WO 2008/116623 A1.
US 2011/0016822 A1—WO 2010/006684 A2.
US 2011/0258959 A1—WO 2010/081532 A1.
U.S. Appl. No. 15/977,210, Kell et al.
U.S. Appl. No. 15/923,475, Boo, et al.
Extended European Search Report dated Jun. 28, 2018 in EP 16737615.1, European Patent Office, Munich, DE, 9 pages.
Boo, Christian, et al., U.S. Appl. No. 15/923,475 entitled "Method for Producing a Mechanical Locking System for Building Panels," filed in the U.S. Patent and Trademark Office on Mar. 16, 2018.
Kell, Richard William, U.S. Appl. No. 15/977,210 entitled "Vertical Joint System and Associated Surface Covering System," filed in the U.S. Patent and Trademark Office on May 11, 2018.
U.S. Appl. No. 14/946,066, Christian Boo and Stefan Stigert, filed Nov. 19, 2015 (Cited herein as U.S. Patent Application Publication No. 2016/0069088 A1 of Mar. 10, 2016).
U.S. Appl. No. 15/695,437, Darko Pervan and Marcus Nilsson Ståhl, filed Sep. 5, 2017 (Cited herein as US Patent Application Publication No. 2017/0362834 A1 of Dec. 21, 2017).
U.S. Appl. No. 15/726,754, Darko Pervan, filed Oct. 6, 2017 (Cited herein as US Patent Application Publication No. 2018/0030737 A1 of Feb. 1, 2018).
International Search Report and Written Opinion dated May 10, 2016 in PCT/SE2016/050019, Patent-och registreringsverket, Stockholm, SE, 22 pages.
Välinge Innovation AB, Technical Disclosure entitled "Mechanical locking for floor panels with Vertical Folding," IP.com No. IPCOM000179246D, Feb. 10, 2009, IP.com PriorArtDatabase, 59 pp.
Välinge Innovation AB, Technical Disclosure entitled "Mechanical locking for floor panels with a flexible bristle tongue." IP.com No. IPCOM000145262d, Jan. 12, 2007, IP.com PriorArtDatabase, 57 pages.

(56) References Cited

OTHER PUBLICATIONS

U.S. Appl. No. 16/204,185, Darko Pervan, filed Nov. 29, 2018.
U.S. Appl. No. 16/253,465, Darko Pervan and Marcus Nilsson Ståhl, filed Jan. 22, 2019.
U.S. Appl. No. 16/204,185, Pervan.
U.S. Appl. No. 16/253,465, Pervan, et al.
Pervan, Darko, U.S. Appl. No. 16/204,185, entitled "Mechanical Locking System for Floor Panels," filed in the U.S. Patent and Trademark Office on Nov. 29, 2018.
Pervan, Darko, et al., U.S. Appl. No. 16/253,465 entitled "Mechanical Locking of Floor Panels with Vertical Snap Folding," filed in the U.S. Patent and Trademark Office on Jan. 22, 2019.

* cited by examiner 4b
1
A-A
11a
20-1
4c
20
B-B
20-2
B-B
20-3
L3
L2
L1
20-4
8
6
4a A-A
4c
7a
41
8

B-B
4c
7b
43
11a
6
20-3

7a
L3
20
L2
L1
S
4c
7b
11a
7a
6

4b
1
A-A
20
20
4c
20
20
B-B
20
20
6
4a
A-A
4c
7a
B-B
4c
7b
20

MECHANICAL LOCKING SYSTEM FOR FLOOR PANELS

TECHNICAL FIELD

The disclosure generally relates to the field of mechanical locking systems for floor panels and building panels. The disclosure shows floorboards, furniture components, locking systems and production methods.

FIELD OF APPLICATION OF THE INVENTION

Embodiments of the present invention are particularly suitable for use in floating floors, which are formed of floor panels having of one or more upper layers comprising, e.g., thermoplastic or thermosetting material or wood veneer, an intermediate core of wood-fibre-based material or plastic material and preferably a lower balancing layer on the rear side of the core. Embodiments of the invention can also be used for joining building panels which preferably contain a board material for instance wall panels, ceilings, furniture components and similar.

The following description of prior-art technique, problems of known systems and objects and features of the invention will therefore, as a non-restrictive example, be aimed above all at this field of application and in particular at laminate floors comprising an HDF core and formed as rectangular floor panels with long and shorts edges intended to be mechanically joined to each other on both long and short edges.

The long and short edges are mainly used to simplify the description of the invention. The panels may be square. Floor panels are generally produced with the surface layer pointing downwards in order to eliminate thickness tolerances of the core material. Some embodiments and production methods are shown with the surface pointing upwards in order to simplify the description.

It should be emphasized that embodiments of the invention can be used in any floor panel on long and/or short edges and it may be combined with all types of known locking systems on long or short edges that lock the panels in the horizontal and/or vertical direction.

BACKGROUND OF THE INVENTION

Relevant parts of this background description are also a part of embodiments of the disclosed invention.

Several floor panels on the market are installed in a floating manner with mechanical locking systems formed at the long and short edges. These systems comprise locking means, which lock the panels horizontally and vertically. The mechanical locking systems are usually formed by machining of the core of the panel. Alternatively, parts of the locking system can be formed of a separate material, for instance aluminium or plastic material, which is integrated with the floor panel, i.e. joined with the floor panel in connection with the manufacture thereof.

Laminate flooring usually comprise a 6-8 mm wood based core, a 0.2 mm thick upper decorative surface layer of laminate and a 0.1 mm thick lower balancing layer. The laminate surface and the balancing layer comprise melamine-impregnated paper. The most common core material is fibreboard with high density and good stability usually called HDF—High Density Fibreboard. The impregnated surface and balancing papers are laminated to the core with heat and pressure. HDF material is hard and has a low flexibility especially in the vertical direction perpendicular to the fibre orientation.

Recently a new type of powder based laminate floors has been introduced. Impregnated paper is replaced with a dry powder mix comprising wood fibres, melamine particles, aluminium oxide and pigments. The powder is applied on an HDF core and cured under heat and pressure. Generally high quality HDF is used with a high resin content and low water swelling. Advanced decors may be formed with digital printing. Water based ink is injected into the powder prior to pressing.

Luxury vinyl tile, LVT, flooring with a thickness of 3-6 mm usually comprises a transparent wear layer which may be coated with an ultraviolet, UV, cured polyurethane, PU, lacquer and a decorative plastic foil under the transparent foil. The wear layer and the decorative foil are laminated to one or several core layers comprising a mix of thermoplastic material and mineral fillers. The plastic core may be rather soft and flexible but also rather rigid depending on the filler content.

Wood Plastic Composite floors generally referred to as WPC floors are similar to LVT floors. The core comprises thermosetting material mixed with wood fibre fillers and is generally stronger and much more rigid than the mineral based LVT core.

Thermoplastic material such as PVC, PP or PE may be combined with a mix of wood fibres and mineral particles and this may provide a wide variety of floor panels with different densities and flexibilities.

Moisture resistant HDF with a high resin content, and WPC floors comprise stronger and more flexible core materials than conventional HDF based laminate floors and they are generally produced with a lower thickness.

The above mentioned floor types comprise different core materials with different flexibility, density and strengths. Locking systems formed in one piece with the core must be adapted to such different material properties in order to provide a strong and cost efficient locking function.

Definition of Some Terms

In the following text, the visible surface of the installed floor panel is called "front side" or "floor surface", while the opposite side of the floor panel, facing the sub floor, is called "rear side". The edge between the front and rear side is called "joint edge". By "horizontal plane" is meant a plane, which extends parallel to the front side. Immediately juxtaposed upper parts of two adjacent joint edges of two joined floor panels together define a "vertical plane" perpendicular to the horizontal plane. By "vertical locking" is meant locking parallel to the vertical plane. By "horizontal locking" is meant locking parallel to the horizontal plane.

By "up" is meant towards the front side, by "down" towards the rear side, by "inwardly" mainly horizontally towards an inner and centre part of the panel and by "outwardly" mainly horizontally away from the centre part of the panel.

Related Art and Problems Thereof

For mechanical joining of long edges as well as short edges in the vertical direction and horizontal direction perpendicular to the edges several methods may be used. One of the most used methods is the angle-snap method. The long edges are installed by angling. Horizontal snapping locks the short edges. The vertical connection is generally a tongue and a groove and the horizontal connection is a strip with a locking element in one edge that cooperates with a locking groove in the adjacent edge. Locking by snapping is obtained with a flexible strip that during the initial stage of locking bends downwards and during the final stage of locking snaps upwards such that the locking element is inserted into the locking groove.

Similar locking systems may also be produced with a rigid strip and they are connected with an angling-angling method where both short and long edges are angled into a locked position.

Advanced so-called "fold down locking systems" with a separate and flexible tongue on a short edge generally called "5G systems" have been introduced where both the long and short edges are locked with an angling action. A floor panel of this type is presented in WO 2006/043893. It discloses a floor panel with a short edge locking system comprising a locking element cooperating with a locking groove, for horizontal locking, and a flexible bow shaped so called "banana tongue" cooperating with a tongue groove, for locking in a vertical direction. The flexible bow shaped tongue is inserted during production into a displacement groove formed at the edge. The tongue bends horizontally along the edge during connection and makes it possible to install the panels by vertical movement. Long edges are connected with angling and a vertical scissor movement caused by the same angling action connects short edges. The snapping resistance is low and only a low thumb pressure is needed to press the short edges together during the final stage of the angling. Such a locking is generally referred to as "vertical folding"

Similar floor panels are further described in WO 2007/015669. This invention provides a fold down locking system with an improved flexible tongue so called "bristle tongue" comprising a straight outer tongue edge over substantially the whole length of the tongue. An inner part of the tongue comprises bendable protrusions extending horizontally along the tongue body.

The above known fold down "5G system" has been very successful and has captured a major market share of the premium world laminate and wood flooring markets. The locking is strong and reliable mainly due to the flexibility and pretension of the separate flexible tongue that allows a locking with large overlapping essentially horizontal locking surfaces. The locking strength and installation is only to a minor extent dependant on the properties of the core since the strength and flexibility is obtained with a well defined tongue made of strong plastic material reinforced with long glass fibres.

The 5G system and similar system have been less successful in the low priced market segments. The major reason is that the cost of the separate tongues and investments in special inserting equipment that is needed to insert a flexible tongue into a displacement groove are still regarded as rather high in relation to the rather low price of the floor panels.

Several attempts have been made to provide a fold down locking system based on a vertical snapping function that may be produced in one piece with the core in the same way as the one piece horizontal snap systems. All such attempts have failed especially when a floor panel comprises an HDF core. This is not a coincidence. The failure is based on major problems related to material properties and production methods. Several of the known locking systems are based on theoretical geometries and designs that have not been tested in industrial applications. One of the main reasons behind the failure is that bending of vertically protruding parts that are used for the vertical locking of edges is limited to about 50% of the floor thickness or to about 4 mm in an 8 mm thick laminate floor panel. As comparison it may be mentioned that a protruding strip for horizontal snapping may extend over a substantial distance from the upper edge and may protrude 8-10 mm beyond the upper edge. This may be used to facilitate a downward bending of the strip and the locking element. In addition a small downward bending of the tongue and upward bending of the upper lip are features that are favourable and may be used to facilitate a horizontal snapping action. Other disadvantages compared to horizontal snapping are that HDF comprises a fibre orientation substantially parallel with the floor surface. The material properties are such that bending of horizontally protruding parts is easier to accomplish than bending of vertically protruding parts. Furthermore, lower parts of an HDF board comprise a higher density and a higher resin content than middle parts and such properties are also favourable for the horizontal snapping systems where the strip is formed in the lower part of the core.

Another circumstance that has supported market introduction of the horizontal one piece snap systems is the fact that a hammer and a knocking block may be used to snap the short edges. Fold down systems are so called tool-less systems and the vertical locking must be accomplished with hand pressure only.

Several attempts have been made to copy the basic principles of the 5G tongue that bends horizontally along its length in an displacement groove during locking and that is very stable in the vertical direction where it is supported over the major part of its width by an upper strong and rigid wall of the displacement groove.

The main problem with one-piece systems based on flexible locking means extending along the joint is the fact that it is difficult to combine a high degree of flexibility in the horizontal direction, that is needed for an easy locking, with a low or preferably non-existent flexibility in the vertical direction that is needed for a high locking strength.

WO 2008/116623 describes a locking system comprising a flexible tongue that bends horizontally along its length. The flexible tongue is formed by jumping tools on an outer or inner part of the fold panel. The jumping tools are used to form cavities above and behind the tongue in order to accomplish flexibility in the length direction of the tongue. The main problem is that the tongue is flexible horizontally but also vertically and the vertical locking strength is very low. The jumping tool forms deep cavities and this reduces the locking strength.

WO 2009/033623 describes a locking system having spring elements that lock adjacent panels vertically. The spring elements are located at an outer part of a locking strip and are formed by a vertical slot located in a locking element at an outer part of the locking strip. During vertical displacement the spring elements are displaced horizontally inwardly by projections formed on the adjacent panel and back again to its initial position. The locking element is used to lock vertically, horizontally and to support the panels such that they are aligned with flat upper edges. Such locking system has several disadvantages. The essentially horizontal contact surfaces located on the locking element may increase the risk for squeaking sound when the panels are moving vertically since the outer part of the strip is not strong enough and is generally much more flexible than the inner part. Locking with a flexible part that moves to its original position cannot create a strong locking and cannot eliminate production tolerances. The forming of a slot in the thicker outer part of the strip is a difficult operation since an unnecessary high amount of material must be removed. Two special tooling stations must be used to for the slots on one short edge and the projections on the other opposite short edge.

WO 2011/001326 describes a one piece locking system where the flexible tongue is formed on the strip panel in a middle section of a core. A deep cut is formed vertically as a cavity with a distance that extends over the major part of the core material and this will reduce the strength of the edge section. Only a few tongues may be formed at an edge and the locking strength is low especially in HDF material where the middle parts have a rather low density and flexibility.

WO 2013/032391 describes a one piece locking system comprising a slit formed in the locking strip. The locking system is mainly intended to lock very thin LVT panels. The locking surfaces are located at the lower part of strip. Such locking systems are less suitable for thicker laminate panels since the large slit that is used to accommodate a locking protrusion results in low locking strength especially due to the fact that the flexibility in the vertical direction is generally larger than the flexibility in the horizontal direction.

The locking systems described above are also difficult to form in a cost efficient way with known production methods.

A one-piece fold down locking system designed such that it may be formed with high-speed equipment in a cost efficient way and with a quality and locking function similar to the advanced 5G systems may be a major advantage.

SUMMARY OF THE INVENTION

An objective of embodiments of the present invention is to provide an improved and more cost efficient fold down locking system for vertical and horizontal locking of adjacent panels wherein the locking system is produced in one piece with the core.

A first specific objective is to provide a locking system wherein a horizontally extending flexible strip may be used to accomplish the vertical and horizontal locking.

A second specific objective is to provide a locking system with essentially horizontally extending locking surfaces for the vertical locking such that a strong locking force may be obtained in the vertical direction.

A third specific objective is to prevent upward bending of flexible parts that are used to obtain a vertical locking of the edges.

A fourth specific objective is to provide several embodiments of locking systems that may be used to meet the specific material properties of different core materials that are used to produce floor panels and furniture components.

A fifth specific objective is to provide locking systems that may be produced with cost efficient methods in a double-end tenor comprising a lower chain and an upper belt that displace the panel in relation to several tool stations.

The above objects of the invention may be achieved by embodiments of the invention.

According to a first aspect of the invention a set of essentially identical floor panels are provided with a mechanical locking system comprising a strip extending horizontally from a lower part of a first edge of a first panel and a downwardly open locking groove formed in an adjacent second edge of a second panel. The strip comprises an upwardly protruding locking element which is configured to cooperate with the locking groove for locking the first edge and the second edge in a horizontal direction parallel to a main plane of the panels and in a vertical direction perpendicularly to the horizontal direction. The locking element and the locking groove comprise an upper and a lower locking surface, which are configured to lock the panels vertically. The strip comprises slits located along the first edge and is configured such that a slit wall is bended horizontally inwardly towards an inner part of the first panel during locking.

The slits may be located closer to an upper part of the first panel than the locking element. Thereby, the slits may be located between the upper part of the first panel and the locking element in a horizontal direction. In a non-restrictive example, the slits may be provided in a thinnest part of the strip. In another non-restrictive example, the slits may be provided in a portion of the strip inside of the thinnest part of the strip.

By a first object being located closer to the upper edge than a second object is here and in the following meant that a horizontal distance between the first object and the upper edge is smaller than a horizontal distance between the second object and the upper edge. This is valid in all aspects and principles of the disclosure, in particular when the object is a locking element, a locking groove, or a slit.

The second edge may be displaced vertically downwards towards the first edge during locking. This includes the case when the second edge is displaced towards the first edge by means of a scissor-like movement, wherein the second edge is gradually displaced towards the first edge from one side edge of the second edge to the other.

By "during locking" is meant at least during an initial stage of the locking. The bending of the slit wall horizontally inwardly towards an inner part of the first panel may occur during an initial stage of the locking.

The slit wall may be further configured to bend horizontally outwardly away from the inner part. The outward bending may occur after the initial stage of the locking. In particular, the outward bending may occur during a final stage of the locking. The slit wall may be configured to be bended at least partly back to an initial position of the slit wall during a final stage of the locking. The initial position of the slit wall may be a position of the slit wall before bending. In a first example, the slit wall is during the final stage bended partly back to the initial position of the slit wall. In a second example, the slit wall is during the final stage bended completely back to the initial position of the slit wall.

The slit wall may be an outer slit wall of the slit. The slit may further comprise an inner slit wall.

There may be at least one slit located along the first edge. In one example, there is one slit located along the first edge. In another example, there is a plurality of slits located along the first edge. Here and in the following, reference will be made only to "slits".

The slits may extend entirely through the strip.

Alternatively, some of all of the slits may extend partly through the strip. In this case, the slits may be provided in a front side of the strip, thereby being open upwardly, and/or in a rear side of the strip, thereby being open downwardly.

Each slit may be defined by two sidewalls along the first edge. In a first embodiment, the sidewalls are vertical. This type of slits may be formed by means of cutting, punching or carving. In a second embodiment, the sidewalls are inclined or curved. Thereby, there are transition regions at the side edges of each slit such that a depth of the slit increases from a minimal depth at a centre portion of the slit to a maximal depth at a side edge of the slit. This type of slits may be formed by means of milling.

The inner and/or outer slit walls may be vertical. According to alternative embodiments, the inner and/or outer slit walls are inclined or curved.

According to one embodiment, a height of the slits in a thickness direction of the panel may be between 10% and 40%, more preferably between 20% and 30%, of a maximal thickness of the first panel.

A width of a slit may be constant or vary along the first edge and/or in a vertical direction, i.e. along a thickness direction. By "width of the slit" is here meant a length of the slit in a direction perpendicular to the vertical plane at a given vertical distance from the rear side of the panel and at a given horizontal distance from a side edge of the edge. In a first non-limiting example, the slit may be wider at a centre portion of the slit than at its side edges, close to the sidewalls. In a second non-limiting example, the slit may be tapering in a vertical direction downwards. In a third non-limiting example, the slit may be tapering in a vertical direction upwards. Any of the embodiments of the slit above may be combined.

A cross section of the locking groove or a cross section of the locking element may vary along the first and the second edge.

The locking system may in a locked position and along the edges comprise a first rigid edge section and a second flexible edge section comprising one of the slits. Optionally, the second flexible edge section may comprise at least two of the slits, in particular a plurality of slits.

By rigid or essentially rigid is meant that during locking the locking element is horizontally displaced by a distance that is less than 2%-20%, e.g. 5%, of a maximal width of the locking element. Moreover, by flexible is meant that during locking the locking element is horizontally displaced by a distance that is larger than 2%-20%, e.g. 5%, of a maximal width of the locking element.

The first rigid edge section may be configured such that the locking element is in contact with the locking groove and the second flexible edge section may be configured such that there is a space between an inner surface of the locking element and an outer groove wall of the locking groove. In particular, in the first rigid edge section, an inner surface of the locking element may be in contact with an outer groove wall of the locking groove. The space may be provided between essentially the entire inner surface of the locking element and the outer groove wall of the locking groove in the second flexible edge section. Alternatively, the space may be provided only along a vertical distance that corresponds to the active locking surfaces located at the first edge section and configured to lock the panels horizontally. The locking element may engage with the locking groove in a locked position of the panels.

According to one embodiment, the edges may be locked with vertical pretension between lower and upper support surfaces and between upper and lower locking surfaces. The locking element with its upper locking surface may only partly snap back to its original position, preferably less than about 80% of a first inward displacement, and may in a locked position be displaced upwardly in relation unlocked position due to inclined upper and lower locking surfaces. This may increase the locking strength considerably, even in the case when the locking element in locked position is only pressed inwardly about 0.1-0.2 mm.

According to one embodiment, the upper locking surface is provided in the second flexible edge section. The upper locking surface may be removed in the first rigid edge section. Instead, there may be a vertical wall or an essentially vertical wall.

According to one embodiment, the lower locking surface is provided at least in the second edge section. Alternatively, the lower locking surface may be provided along the entire edge of the second panel.

The edge of the first panel may comprise upper and lower stabilizing surfaces that in locked position overlap each other and prevent an upward bending of the slit wall. By overlap is meant that the stabilizing surfaces form a non-zero overlap at least in a direction perpendicular to the vertical plane and also at least along a portion of the edges. The stabilizing surfaces may engage with each other in the locked position. In particular, the stabilizing surfaces may engage with each other with pretension. Moreover, the lower and/or upper stabilizing surfaces may be provided in the second flexible edge section. According to one embodiment, the upper stabilizing surface is a wall portion of a slit. The wall portion may be an upper wall portion of a slit. According to one embodiment, the lower stabilizing surface is an upper portion of the strip. Optionally, the upper portion of the strip may be arranged in an inner part of the strip.

According to a second aspect of the invention a set of essentially identical floor panels are provided having a mechanical locking system comprising a strip extending horizontally from a lower part of a first edge and a downwardly open locking groove formed in an adjacent second edge. The strip comprises a first and a second upwardly protruding locking element. The first locking element is located closer to the upper edge than the second locking element. The first locking element comprises an upper locking surface at its upper and outer part. The second edge comprises a downwardly extending protrusion comprising a lower locking surface at its outer and lower part. The second locking element cooperates with the locking groove and locks the first and the second edge in a horizontal direction parallel to a main plane of a first and a second panel and the upper and lower locking surfaces lock the adjacent edges in a vertical direction perpendicularly to the horizontal direction. The first and the second edge in comprise in locked position a first edge section and a second edge section along the first and the second edge, wherein a cross section of the first locking element or a cross section of the protrusion varies along the first and/or the second edge. The second edge section comprises a first and a second slit extending side by side along the edge. The first slit is located closer to the upper part of the first edge than the second slit. The second slit is formed between the first and the second locking elements. The locking system is configured to be locked with a vertical displacement of the second edge against the first edge wherein a part of the first locking element and a slit wall of the first and the second slits during an initial stage of the vertical displacement is configured to bend horizontally inwards towards an inner part of the first panel and during a final stage of the vertical displacement is configured to bend outwards towards its initial position.

The upper edge may be an upper edge or upper part of the first edge.

The first edge and the second edge may be an edge of the first panel and an edge of the second panel, respectively.

The first edge may comprise upper and lower stabilizing surfaces that in the locked position overlap each other and prevent an upward bending of one of the slit walls.

Embodiments of the second aspect of the invention are largely analogous to embodiments of the first aspect of the invention, wherein reference is made to the above. In particular, the characteristics of the slits, the upper and lower locking surfaces and the stabilizing surfaces are analogous.

In addition, the upper stabilizing surface may be a wall portion of a first slit. The wall portion may be an upper wall portion of a first slit.

There may be one first slit and one second slit. Alternatively, there may be a plurality of first and/or second slits.

According to a third aspect of the invention a set of essentially identical floor panels are provided with a mechanical locking system is provided. The panel edges comprise a strip extending horizontally from a lower part of a first edge and a downwardly open locking groove formed in an adjacent second edge. The strip comprises an upwardly protruding locking element comprising an upper locking surface at its upper and inner part and the locking groove comprises a lower locking surface at its outer and lower part. The locking element cooperates with the locking groove and locks the first and the second edge in a horizontal direction parallel to a main plane of a first and a second panel. The upper and lower locking surfaces lock the adjacent edges in a vertical direction perpendicularly to the horizontal direction. The first and the second edge comprise in locked position a first edge section and a second edge section along the first and the second edge, wherein a cross section of the locking element or a cross section of the locking groove varies along the first and/or the second edge. The strip of the second edge section comprises a slit extending along the first edge. The slit is located between the locking element and an upper edge, wherein the locking system is configured to be locked with a vertical displacement of the second edge against the first edge wherein a part of the locking element and a slit wall during an initial stage of the vertical displacement is configured to bend horizontally outwardly and during a final stage of the vertical displacement is configured to bend inwardly towards its initial position.

The first panel, in particular the first edge, may comprise upper and lower stabilizing surfaces that in locked position overlap each other and prevent an upward bending of a part of the locking element.

Embodiments of the third aspect of the invention are largely analogous to embodiments of the first aspect of the invention, wherein reference is made to the above. In particular, the characteristics of the slits and the stabilizing surfaces are analogous. In addition, the slit may be a first slit and the upper stabilizing surface may be an upper wall of a second slit provided in the strip. The first slit may be provided closer to an upper part of the first edge than the second slit. It is noted, however, that according to the third aspect the direction of the bending is reversed as compared to the first aspect.

Additionally, according to one embodiment, there is a space formed between an inner groove wall of the locking groove and the locking element in a locked position of the panels. The space may allow for a horizontal displacement outwardly of the locking element. The space may extend along essentially the entire edge. Alternatively, however, the space may extend along a part of the edge, preferably at least along the second edge section.

According to one embodiment, the upper locking surface is provided in the second edge section. The upper locking surface may be removed in the first edge section. Instead, there may be a vertical wall.

According to one embodiment, the lower locking surface is provided at least in the second edge section. Alternatively, the lower locking surface may be provided along the entire edge of the second panel.

According to a fourth aspect of the invention a set of essentially identical floor panels are provided with a mechanical locking system comprising a strip extending horizontally from a lower part of a first edge and a downwardly open locking groove formed in an adjacent second edge. The strip comprises an upwardly protruding locking element and the second edge comprises a downwardly extending protrusion comprising a lower locking surface at its lower and outer part. The locking element cooperates with the locking groove and locks the first and the second edge in a horizontal direction parallel to a main plane of a first and a second panel. The first and the second edge in locked position comprise a first edge section and a second edge section along the first and the second edge, wherein a cross section of the protrusion varies along the first and/or the second edge. The second edge section comprises a first and a second slit extending side by side along the edge. The first slit is located closer to the upper part of an edge, in particular the first edge, than the second slit. The second slit is configured to accommodate the protrusion and the lower locking surface such that the lower locking surface locks against an upper locking surface located at a lower and inner part of the second slit and locks the edges in a vertical direction. The locking system is configured to be locked with a vertical displacement of the second edge against the first edge wherein a flexible strip part located between the first and the second slit during an initial stage of the vertical displacement is configured to bend horizontally inwardly and during a final stage of the vertical displacement is configured to bend outwardly towards its initial position.

The edge of the first panel, in particular the first edge, may comprise upper and lower stabilizing surfaces that in locked position overlap each other and prevent an upward bending of the flexible strip part.

There may be one first slit and one second slit. Alternatively, there may be a plurality of first and/or second slits.

Embodiments of the fourth aspect of the invention are largely analogous to embodiments of the first aspect of the invention wherein reference is made to the above. In particular, the characteristics of the slits and the stabilizing surfaces are analogous. In addition, the upper stabilizing surface may be a wall portion of a first slit. The wall portion may be an upper wall portion of a first slit.

Furthermore, the upper locking surface may be located at an outer and lower part of the flexible strip part. The flexible strip part may be configured to bend horizontally inwardly into the first slit.

According to one embodiment, the lower locking surface is provided in the second edge section. The lower locking surface may be removed in the first edge section. Instead, there may be a vertical wall.

According to one embodiment, the upper locking surface is provided at least in the second edge section. Alternatively, the upper locking surface may be provided along the entire edge of the second panel.

According to a fifth aspect of the invention a set of essentially identical floor panels are provided with a mechanical locking system comprising a strip extending horizontally from a lower part of a first edge and a first and a second downwardly open locking groove formed in an adjacent second edge. The first locking groove is located closer to the upper edge than the second locking groove. The strip comprises a first upwardly protruding locking element and a second locking element. The first locking element is located closer to the upper edge than the second locking element. The second edge comprises a downwardly extending protrusion comprising a lower locking surface at its lower and inner part. The first locking element cooperates with the first locking groove and locks the first and the second edge in a horizontal direction parallel to a main plane of a first and a second panel. The first and the second edge comprise in locked position a first edge section and a second edge section along the first and the second edge, wherein a cross section of the protrusion varies along the first and/or the second edge. The second edge section comprises a slit configured to accommodate the protrusion and the lower locking surface such that the lower locking surface locks against an upper locking surface located at a lower and inner part of the second locking element and locks the edges in a vertical direction. The locking system is configured to be locked with a vertical displacement of the second edge against the first edge wherein the second locking element during an initial stage of the vertical displacement is configured to bend horizontally and outwardly and during a final stage of the vertical displacement is configured to bend inwardly towards its initial position.

The first panel, in particular the first edge, may comprise upper and lower stabilizing surfaces that in locked position overlap each other and prevent an upward bending of the second locking element.

Embodiments of the fifth aspect of the invention are largely analogous to embodiments of the first aspect of the invention wherein reference is made to the above. In particular, the characteristics of the slits and the stabilizing surfaces are analogous. In addition, in the second edge section the upper locking surface may be provided in an outer and lower part of the slit. It is noted, however, that in the fifth aspect the direction of the bending is reversed as compared to the first aspect.

According to one embodiment, the slit is a first slit and the second edge section further comprises a second slit, wherein the first and the second slit extend side by side along the first edge, the first slit being located closer to an upper part of the first edge than the second slit. If this embodiment is provided with stabilizing surfaces according to any of the embodiments above, the upper stabilizing surface may be a wall portion of the second slit. The wall portion may be an upper wall portion of the second slit.

There may be one first slit and one second slit. Alternatively, there may be a plurality of first and/or second slits.

According to one embodiment, the lower locking surface is provided in the second edge section. The lower locking surface may be removed in the first edge section. Instead, there may be a vertical wall.

According to one embodiment, the upper locking surface is provided at least in the second edge section. Alternatively, the upper locking surface may be provided along the entire edge of the second panel.

According to a sixth aspect of the invention, there is provided a set of essentially identical furniture components provided with a mechanical locking system for locking a first edge of a first furniture component and a second edge of a second furniture component essentially perpendicularly to each other. The first edge comprises a strip extending from the first edge, wherein the strip comprises a locking element. The second edge comprises a locking groove. The locking element is configured to cooperate with the locking groove for locking the first edge and the second edge in a vertical direction perpendicular to an outer surface of the first furniture component and in a horizontal direction perpendicular to an outer surface of the second furniture component. The locking element and the locking groove comprise an upper and a lower locking surface that are configured to lock the furniture components in the vertical direction. The strip comprises a slit located along the first edge, wherein a slit wall of the slit is configured to be bended horizontally inwardly towards an inner part of the first furniture component during locking. The locking system comprises a first rigid edge section and a second flexible edge section along the first and second edges. The second flexible edge section comprises the slit. In a locked position, the first rigid edge section is configured such that the locking element is in contact with the locking groove and the second flexible edge section is configured such that there is a space between an inner surface of the locking element and a groove wall of the locking groove.

The edge of the first furniture component may comprise upper and lower stabilizing surfaces that in locked position overlap each other and prevent an upward bending of the slit wall.

Embodiments of the sixth aspect of the invention are largely analogous to embodiments of the first aspect of the invention wherein reference is made to the above. In particular, the characteristics of the slits, upper and lower locking surfaces, and the stabilizing surfaces are analogous. It is noted, however, that the sixth aspect is directed to furniture components.

According to a seventh aspect of the invention, there is provided a set of essentially identical floor panels provided with a mechanical locking system comprising a strip formed in one piece with a core of a first panel and extending horizontally from a lower part of a first edge of the first panel. The locking system further comprises a downwardly open locking groove formed in an adjacent second edge of a second panel, the strip comprising an upwardly protruding locking element which is configured to cooperate with the locking groove for locking the first edge and the second edge in a horizontal direction parallel to a main plane of the panels and in a vertical direction perpendicularly to the horizontal direction. The locking element and the locking groove comprise an upper and a lower locking surface that are configured to lock the panels vertically. The strip comprises slits located along the first edge, and a slit wall is configured to be bended horizontally inwardly towards an inner part of the first panel during locking. The core has a higher content of cured resins at a lower and outer part than at a lower and inner part.

The resin may be a thermosetting resin.

The lower and outer part may comprise at least a portion of the strip. Alternatively, or additionally, the lower and outer part may comprise a portion of the second panel located inside of and/or below an outer part of the lower locking surface.

The core may have a higher content of cured resins at an upper and outer part than at an upper and inner part.

The upper and outer part may comprise a portion inside of an upper edge of the first panel. Alternatively, or additionally, the upper and outer part may comprise a portion inside of an upper edge of the second panel.

Embodiments of the seventh aspect of the invention are largely analogous to embodiments of the first aspect of the invention wherein reference is made to the above. In particular, the characteristics of the slits, upper and lower locking surfaces, and the stabilizing surfaces are analogous. Additionally, it is emphasized that the feature of having a higher content of cured resins at lower/upper and outer parts than at lower/upper and inner parts may be combined with locking systems according to any of the other aspects of the invention described above.

BRIEF DESCRIPTION OF THE DRAWINGS

The disclosure will in the following be described in connection to exemplary embodiments and in greater detail with reference to the appended exemplary drawings, wherein.

DETAILED DESCRIPTION OF EMBODIMENTS OF THE INVENTION

The embodiments in FIGS. 1*a*-1*d* are used to explain some main problems related to flexible locking elements made in one piece with a core and some basic principles of the inventive concept.

Locking systems comprising flexible and bendable parts formed in one piece with the core are to a major extent dependent of the material properties and thickness of the core that may vary between various core materials and between the same type of core materials. Each locking system must be formed with a specific geometry that is optimized in relation to the properties and thickness of the specific floor panel. This means that a locking system must provide a variety of alternative geometries and principles that could be combined in order to meet the requirements of normal tolerances used in a cost efficient high speed production, locking strength, easy and reliable installation. The inventive concept provides several principles that may be combined and may be used to form a locking system in a specific floor panel.

Figure 1A:
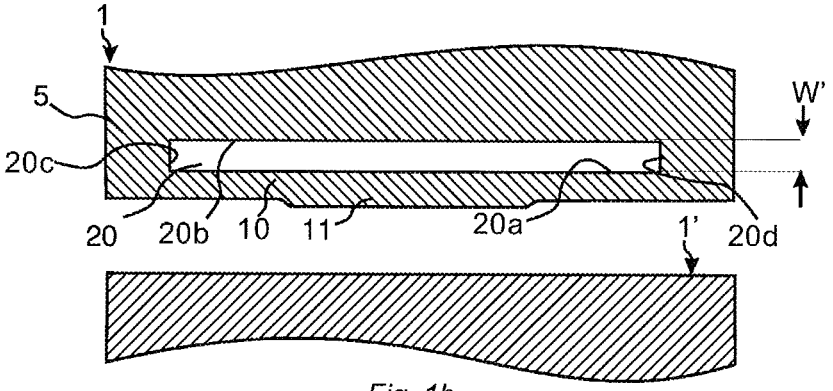
FIGS. 1*a-d* illustrates main principles according to an embodiment of the invention.

FIG. 1*a* is a plan view of an edge of a first 1 and a second 1' panel according to an embodiment. A cutting tool, for example a jumping tool head, a rotating carving tool or a punch, may be used to cut an upwardly and downwardly open slit 20 in the core material 5 and a flexible tongue 10 comprising a locking surface 11 may be formed adjacent to the slit 20. The flexible tongue 10 is provided outwardly of the slit 20. The slit 20 comprises an outer slit wall 20*a*, an inner slit wall 20*b* and two slit sidewalls 20*c*, 20*d*. The slit and the tongue have a length direction L along the joint and a thickness T in the vertical direction as shown in FIG. 1*c*. The flexible tongue 10 has a width W in a horizontal direction that is perpendicular to the length direction and to the thickness direction. According to the present embodiment, the width W varies along the first edge in an unlocked position of the panels 1, 1'. Indeed, the width W is larger at a location of the locking surface 11, which protrudes outwardly in the horizontal direction, than at a location along the edge next to the locking surface 11. Moreover, the open slit 20 has a width W' in a horizontal direction which is perpendicular to the length direction and to the thickness direction. According to the present embodiment, in an unlocked position the width W' is constant along the first edge as well as in the thickness direction.

Figure 1B:
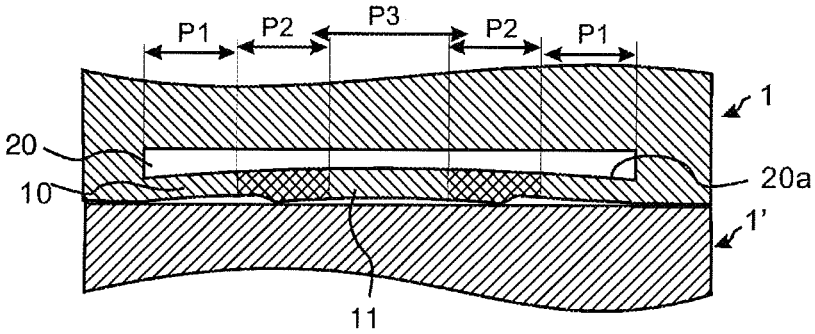
Figure 1C:
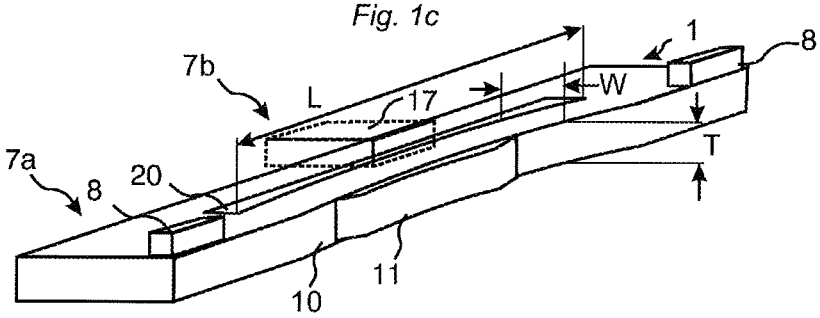
Figure 1D:
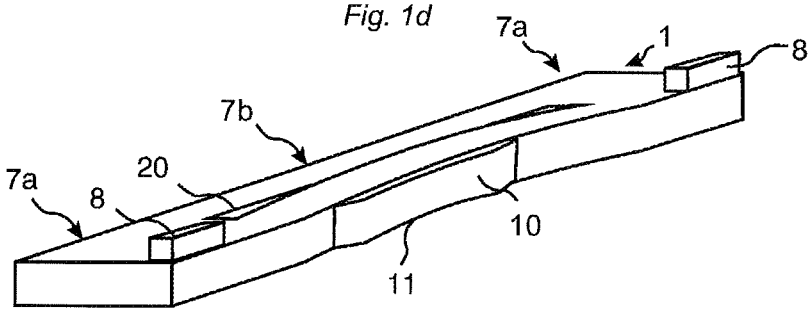

FIG. 1*b* shows the flexible tongue 10 in FIG. 1*a* in a bended position when an edge of the second panel 1' presses the flexible tongue 10 and the outer slit wall 20*a* inwardly during locking. During locking the locking surface 11 engages with the edge of the second panel 1'. Tests of various core materials, especially wood based core materials such as HDF, show that the tongue 10 generally comprises three tongue portions P1, P2, P3 with essentially different properties that will be described next in non-limiting embodiments. The two end portions P1 located close to the slit sidewalls 20*c*, 20*d* are only possible to bend slightly inwardly and cannot be used to accommodate a locking surface 11 that must be displaced over a specific distance in order to provide a sufficient locking strength. The middle section P3 may accommodate a locking surface but such tongue part is very easy to bend inwardly but also upwardly as shown in the embodiments in FIGS. 1*c* and 1*d* and the locking strength in this part of the flexible tongue is generally not sufficient. According to the present embodiment, only the two active portions P2 located between the end portions P1 and the middle portion P3 comprises sufficient flexibility and sufficient locking strengths. Known flexible tongues are such that only about 20% of the length L of the flexible tongue may be used for a vertical locking of adjacent edges. The major part of the tongue 10 is either not possible to bend or is too weak to provide a sufficient locking strength.

One solution to this problem would be to form a lot of small flexible tongues along the edge configured such that they are rather easy to bend horizontally inwardly during the vertical folding but hard to bend vertically upwards in locked position. This may be accomplished with several small flexible tongues that are not possible to form with the known production methods and especially not tongues which must be formed by rotating tools that form deep cavities in a core material and that are only open in one direction vertically or horizontally. One solution is to form the small tongues with a thickness T that is larger than the width W and this provides a horizontal flexibility that exceeds the vertical flexibility. Removal of material that may be accomplished by forming an open slit 20 or just by removing material from an edge provides major advantages related to forming of an appropriate joint geometry.

Another solution to this problem would be to form a locking system comprising a stabilizing edge section 17 as shown in FIG. 1*c* that may be used to prevent upward bending of the flexible tongue 10 in locked position. This may be accomplished with a locking system comprising a flexible tongue 10 that in a final locked position is slightly bended such that a part of the tongue 10 overlaps a stabilizing part 17 located above a part of the tongue. An advantage is that the stabilizing part will be most active at the weak middle portion P3 that may be most bended in locked position. Such geometry makes it possible to form flexible tongues 10 comprising sufficient locking strengths and flexibility along 50% or more of the tongue length L.

The locking system according to embodiments of the invention is three dimensional and comprises preferably a first rigid edge section 7*a* having a vertically protruding locking element 8 for horizontal locking and a second flexible edge section 7*b* comprising a flexible slit 20 that may be bended inwardly such that a distance between the outer 20*a* and inner 20*b* slit walls decreases during bending and/or outwardly such that the distance between the slit walls 20*a*, 20*b* increases during bending. The distance may be a minimal distance between the outer 20*a* and inner 20*b* slit walls. The first rigid edge section 7*a* and the second flexible edge section 7*b* are provided along the edges of the first 1 and second 1' panels. In FIGS. 1*a-d* the second flexible edge section 7*b* is provided in a centre section of the edges of the panels 1, 1' and first rigid edge sections 7*a* are provided on both sides of the second flexible edge section 7*b*. The first rigid edge sections 7*a* may be provided at corner sections of the edges. According to the present embodiment, there is no locking element 8 provided in the second flexible edge section 7*b*.

FIGS. 2-5 show production methods that may be used to form three-dimensional locking systems according to embodiments of the invention. In particular, the production methods may be used for producing cavities, protrusions, grooves and slits according to any of the principles of the present disclosure. FIG. 2*a* shows a tool comprising several rotating saw blades 40 that are displaced against a panel edge 1 and back again. Alternatively, the panel 1 may be displaced against the saw blades 40 and back again. This production method may be used to form cavities 37 or protrusions 36 as shown in FIGS. 2*b* and 2*c*.

Figure 2A:
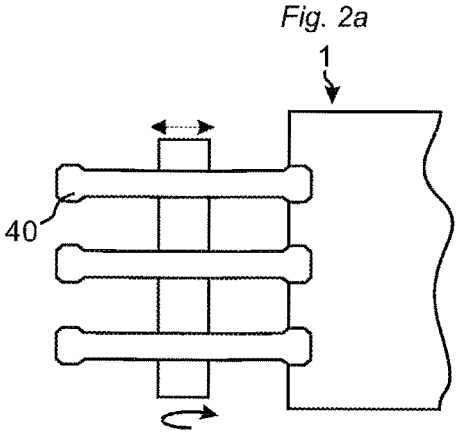
FIGS. 2*a-e* illustrate production methods to form locking systems.
Figure 2B:
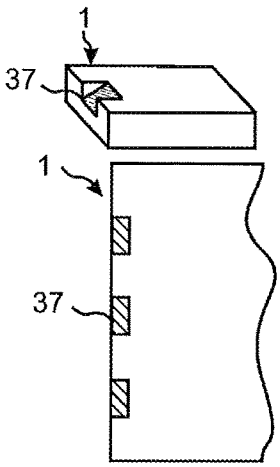
Figure 2C:
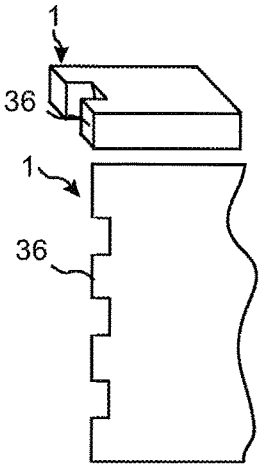
Figure 2D:
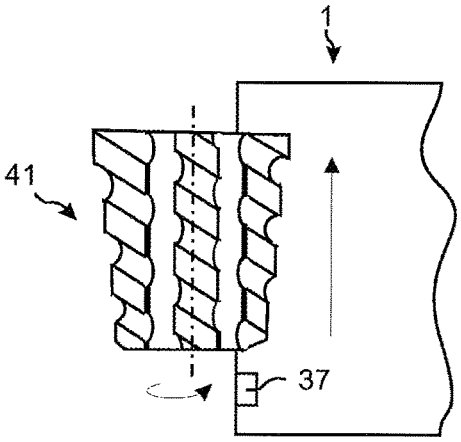
Figure 2E:
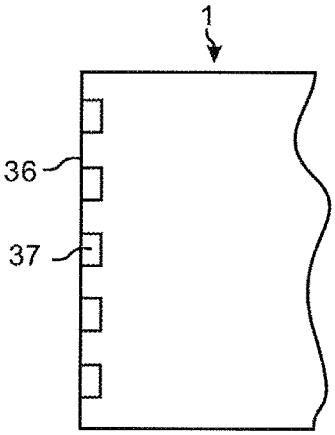

FIG. 2*d* shows a top view of a so-called screw cutter 41. This is an advanced production technology that allows high precision and cost efficient forming of protrusions 36 and cavities 37 perpendicular to a panel edge 1 that is displaced in high speed against the screw cutter. WO 2010/087752 provides a detailed description of the screw cutter principle. The resulting protrusions 36 and cavities 37 are shown in FIG. 2*e*.

Figure 3A:
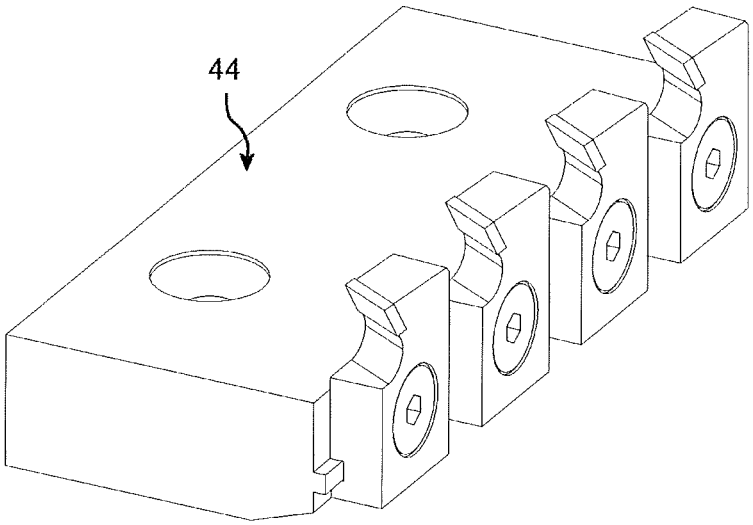
FIGS. 3*a-b* illustrate production methods to form locking systems.
Figure 3B:
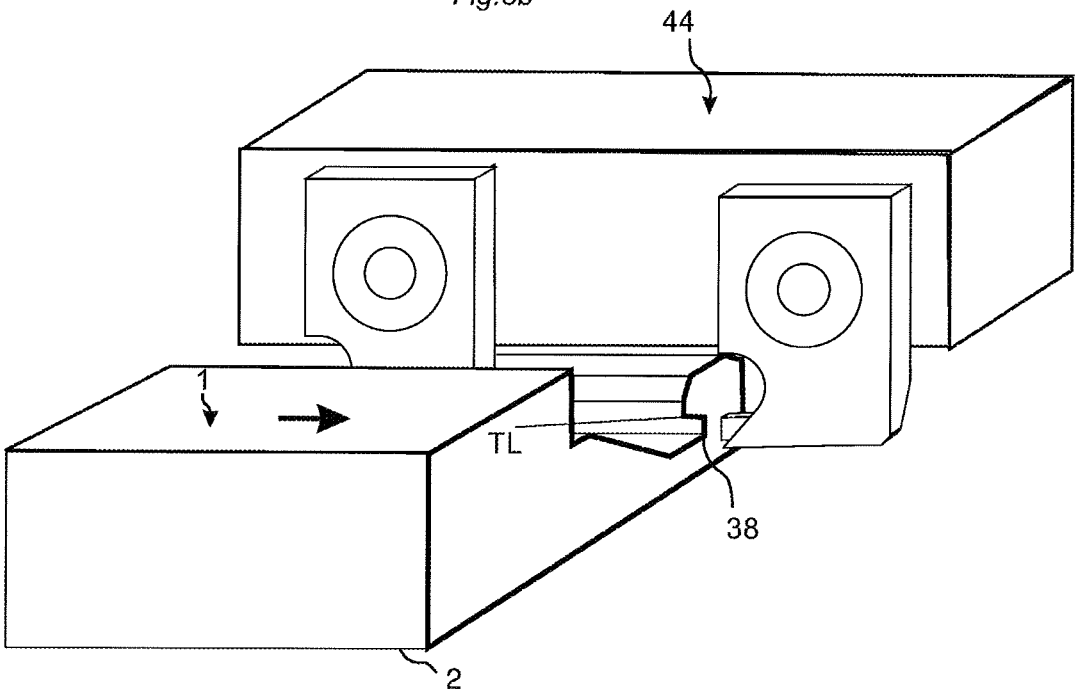

FIGS. 3*a* and 3*b* show a panel 1 with a surface 2 pointing downwards and carving tool 44 that may be used to formed an undercut groove 38 that is not possible to form with large rotating tools since a tangent line TL to a part of the undercut groove intersects the panel edge. The carving tool is fixed and the panel 1 is displaced against the carving tool. A more detailed description of carving may be found in WO 2013/191632.

Figure 4A:
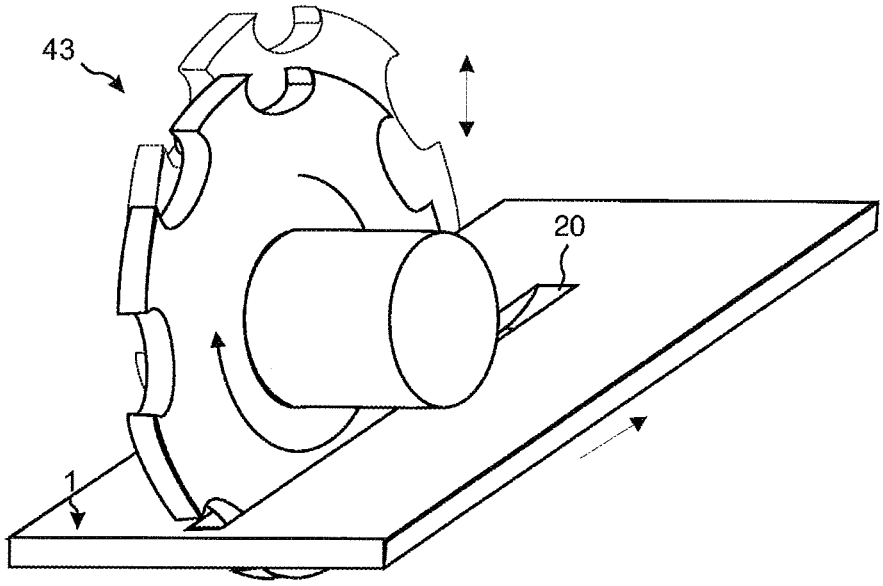
FIGS. 4*a-b* illustrate production methods to form locking systems.
Figure 4B:
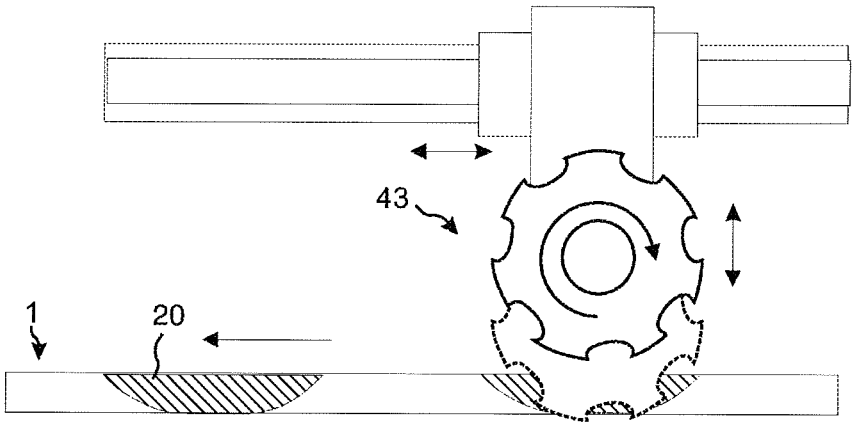

FIG. 4*a* shows a so-called rotating jumping tool head 43 that may be displaced vertically or horizontally against a moving panel edge 1 and that may be used to form a slit 20. FIG. 4*b* is a side view of a jumping tool head that is displaced vertically up and down but also along the feeding direction of a panel 1. The jumping tool head may move horizontally parallel with the panel edge and with a speed that is somewhat lower than the speed of the panel. Several slits 20 may be formed one after each other in the feeding direction and at high speed. Several jumping tools may also be used. One jumping tool may form a first, a third and a fifth slit 20 and another jumping tool may form a second and a fourth slit.

Figure 5A:
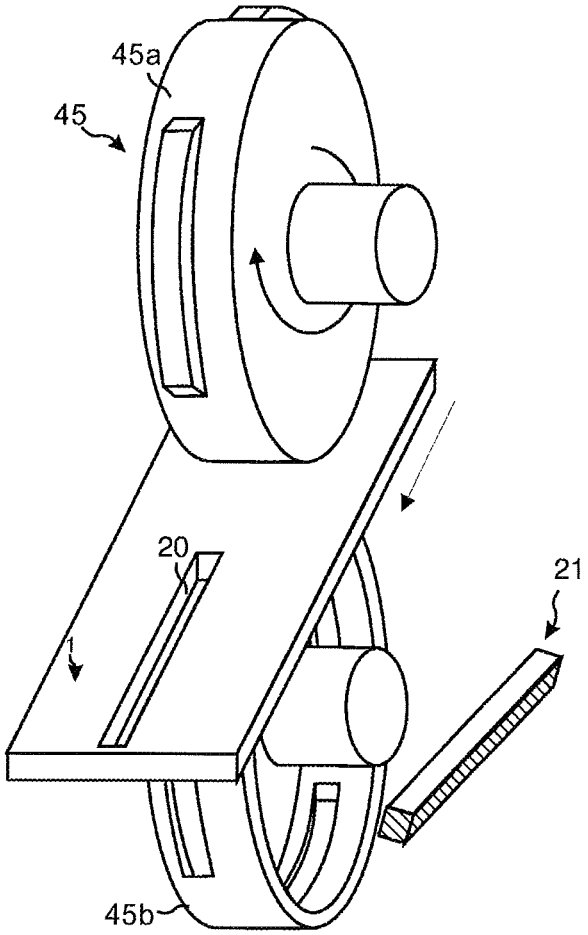
FIGS. 5*a-b* illustrates punching and carving of core material.
Figure 5B:
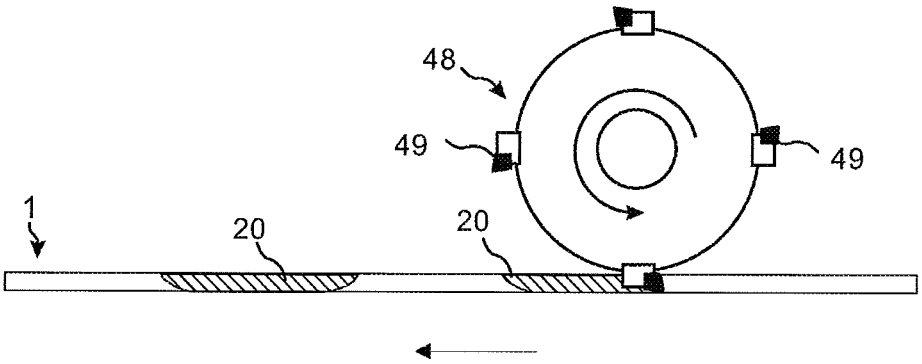

FIG. 5*a* shows a rotating punching tool set 45 comprising a punching wheel 45*a* and a die wheel 45*b*. Such tools may be used to punch slits 20 or to remove material from a panel 1 comprising for example LVT, WPC or HDF material. The punching process produces residual material 21 that may be recycled. The punched slits may have various shapes, for example oval, circular or rectangular and the walls are preferably vertical. FIG. 5*b* shows another cost efficient method to form slits 20 with a rotating carving tool 48. The tool rotation is synchronized with the displacement of the panel 1 and each tooth 49 forms one slit at a predetermined position and with a predetermined horizontal extension along an edge of a panel 1. It is not necessary to displace the carving tool vertically. A carving tool 48 may have several sets of teeth 49 and each set may be used to form one cavity. The cavities may have different cross sections depending on the geometry of the teeth. The panel 1 may be displaced along or against the tool rotation.

Figure 6A:
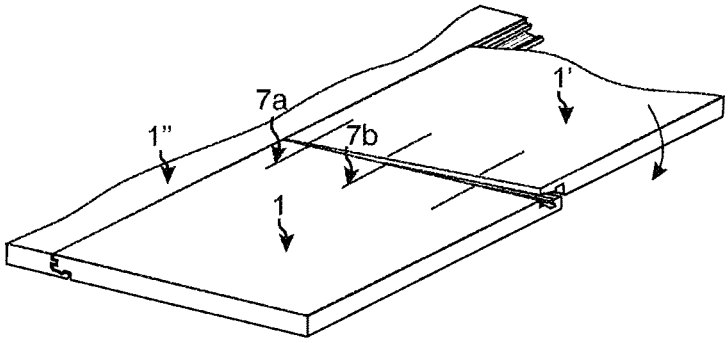
FIGS. 6*a-e* illustrate an embodiment of a first principle of the invention.

FIG. 6*a* shows vertical folding of a second panel 1' that is angled against a previously installed panel 1" in a previous row and wherein this angling action also connect a short edge of the second panel 1' to a short edge of a first panel 1. The short edges of the first 1 and the second 1' panels are locked with a scissor like movement wherein the short edges are gradually locked from one long edge to the other long edge. The adjacent short edges of the first and the second panels 1, 1' have along its edges a first joint edge section 7*a* that preferably becomes active during a first initial step of the folding action and a second joint edge 7*b* section that becomes active during a second stage of the folding action. It is clear that there may be additional joint edge sections 7*a*, 7*b* that subsequently become active. For example, the first joint edge section 7*a* and the second joint edge section 7*b* may be arranged alternately, e.g. as {7*a*, 7*b*, 7*a*, . . . , 7*a*, 7*b*, 7*a*} with first joint edge sections 7*a* at corner sections of the edges. As will be described below, the first joint edge section may be a first rigid edge section 7*a* and the second joint edge section may be a second flexible edge section 7*b*.

Figure 6B:
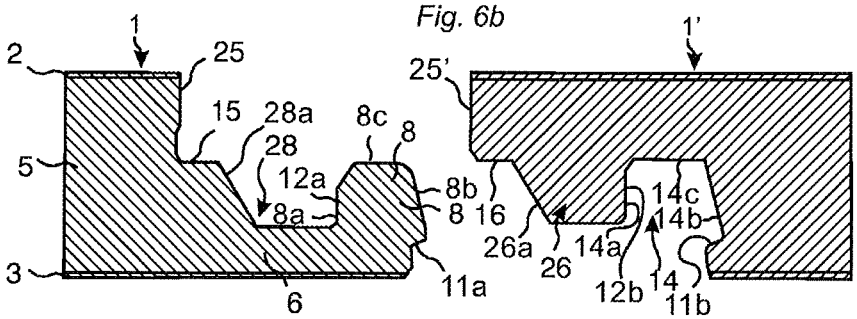

FIGS. 6*b*-6*e* show an embodiment according to a first principle of the invention. A set of similar floor panels 1, 1' is provided wherein each floor panel preferably comprises a surface layer 2, a core 5, a balancing layer 3 and a first and a second short edge. As shown in FIG. 6*b*, the adjacent edges are initially formed with a geometry that only allows a locking with a sideways sliding action where the panel edges are inserted into each other with a horizontal displacement along the short edges. The panels are not possible to lock with angling, horizontal snapping or vertical snapping.

Figure 6C:
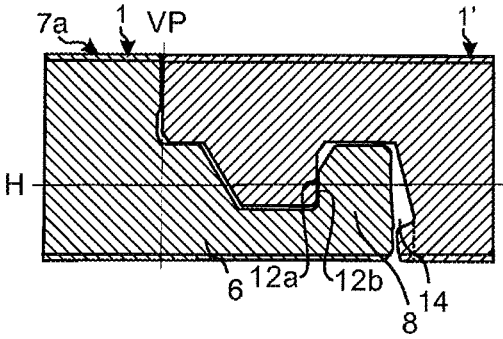
Figure 6D:
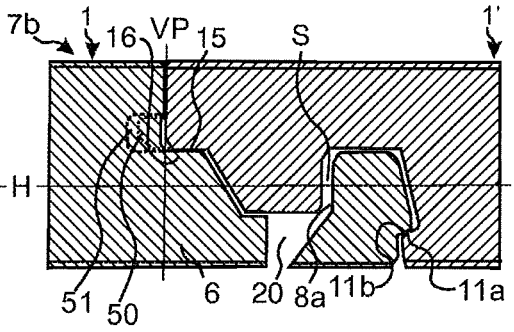

The edges are in a second step adjusted and a part of the material at the edges is removed as shown in FIGS. 6*c* and 6*d* such that a first short edge of a first floor panel 1 may be locked to an adjacent second edge of a similar second floor panel 1' with a vertical displacement of the second edge against the first edge. The vertical displacement is a vertical scissor movement caused by the same angling action that is used to connect the long edges of the panels. The first edge comprises a horizontally protruding strip 6 with a vertically protruding locking element 8 at its outer part that cooperates with a downwardly open locking groove 14 formed in the adjacent second edge.

The locking element comprises an inner surface 8*a*, an outer surface 8*b* and an upper surface 8*c*. The inner surface 8*a* is closer to the upper edge 25 of the first panel 1 than the outer surface 8*b*. By upper edge 25 of the first panel 1 is meant an upper part of the first edge of the first floor panel 1. The locking groove 14 comprises an outer groove wall 14*a*, an inner groove wall 14*b* and an upper groove wall 14*c*. The outer groove 14*a* wall is closer to the upper edge 25' of the second panel 1' than the inner groove wall 14*b*. By upper edge 25' of the second panel 1' is meant an upper part of the second edge of the second floor panel 1'. The locking element 8 comprises an upper locking surface 11*a* formed in the outer surface 8*b* of the locking element 8 that in a locked position of the panels 1, 1' cooperates with a lower locking surface 11*b* formed in the inner groove wall 14*b* and that locks the adjacent edges in a vertical direction. According to the present embodiment, the upper 11*a* and lower 11*b* locking surfaces are inclined against a horizontal plane. In non-limiting examples, the inclination angle may be between 0° and 45°, more preferably between 5° and 25°, e.g. 20°. The locking element 8 comprises a first locking surface 12*a* formed in the inner surface 8*a* of the locking element 8 that in a locked position cooperates with a second locking surface 12*b* formed in the outer groove wall 14*a* and that locks the adjacent edges in a horizontal direction. According to the present embodiment, the first 12*a* and second 12*b* locking surfaces are essentially vertical walls. The second edge comprises a projection 26 that is adapted to engage with an indentation 28 in the first edge in a locked position. The edges comprise lower and upper support surfaces 15, 16 that in a locked position cooperate with the upper and lower locking surfaces 11*a*, 11*b* and prevent the edges to be displaced vertically downwards and vertically upwards. According to the present embodiment, the lower support surface 15 is provided in the first panel 1 between the upper edge 25 and an inner surface 28*a* of the indentation 28, and the upper support surface 16 is provided in the second panel 1' between the upper edge 25' and an outer surface 26*a* of the projection 26. Moreover, the lower support surface 15 is provided adjacent to the upper edge 25 and the upper support surface 16 is provided adjacent to the upper edge 25'. According to the present embodiment, the lower and upper support surfaces 15, 16 are horizontal but it is understood that inclined lower and upper support surfaces are equally conceivable.

Adjacent edges comprise in locked position a first essentially rigid edge section 7*a* and a second flexible edge section 7*b* as shown in FIGS. 6*c* and 6*d*, respectively. The edge sections are characterized in that a cross section of the locking groove 14 and/or a cross section of the locking element 8 varies at a horizontal plane H along the adjacent edges 1, 1' which are formed with a basic geometry as shown in FIG. 6*b* that is thereafter modified such that the first 7*a* and the second 7*b* cooperating edge sections are formed with different geometries and different locking functions as shown in FIGS. 6*c* and 6*d*.

It is understood that according to alternative embodiments the geometries according to FIGS. 6*c* and 6*d* may be formed directly without first forming a basic geometry as in FIG. 6*b*.

The first edge section 7*a* is preferably a start section that becomes active during a first initial step of the folding action and the second edge section 7*b* is preferably a section that becomes active during a second step of the folding action.

FIG. 6*c* shows a first cooperating edge section 7*a* that is used to prevent edge separation during locking and to lock adjacent edges horizontally in the locked position. The first edge section 7*a* has no vertical locking function since one of the locking surfaces, the upper 11*a* or as shown in this preferred embodiment the lower locking surface 11*a*, has been removed. The first 12*a* and the second 12*b* locking surfaces are preferably vertical and they are used to guide the second panel 1' during the vertical displacement along a vertical plane VP that intersects the upper and outer edge of the first panel 1.

FIG. 6*d* shows the second edge section 7*b* that is used to lock the adjacent edges vertically. The second edge 7*b* section cannot prevent horizontal edge separation and has no horizontal locking function since a part of the locking element 8 and/or the locking groove 14 has been removed in order to form a space S along a horizontal plane H and a slit 20 adjacent to the locking element allows the locking element 8 to be displaced inwardly during locking. The slit 20 is preferably located closer to the upper edge 25 of the first panel 1 than the locking element 8. This inward displacement enables the upper 11*a* and lower 11*b* locking surfaces to overlap and lock against each other when the second edge 1' is displaced vertically along the vertical plane VP until a final position where lower 15 and upper 16 support surfaces are in contact with each other. All shown and described locking systems are primarily intended to be used on the short edges. However, it is not excluded that the disclosed embodiments of locking systems may be used on short and/or long edges and the panels may be locked with a vertical displacement of long and/or short edges.

In FIGS. 6*c* and 6*d* the cross section in the first rigid edge section 7*a* is different from the cross section in the second flexible edge section 7*b* due to the space S and/or the slit 20 and therefore the cross section varies along the edges.

The panel edges may also comprise a second horizontally extending tongue 50 and a tongue groove 51 formed in the upper part of the panels as shown in FIG. 6*d* and inclined first and second locking surfaces 12*a*, 12*b* (not shown) such that they may be locked with an angling action wherein the upper and lower locking surfaces 11*a*, 11*b* may prevent the strip to bend down when a horizontal separation force is applied after locking. This may be used to increase the locking strength at for example at the long and/or short edges, especially in soft LVT material.

Figure 6E:
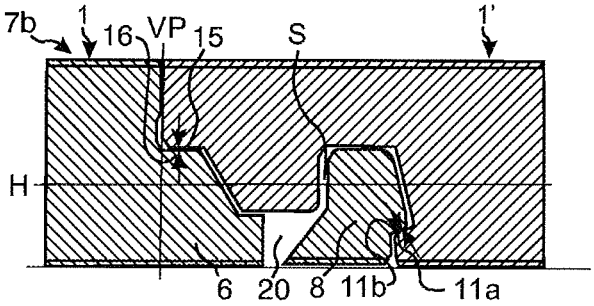

FIG. 6*e* shows that it may be a major advantage to lock the edges with vertical pretension between lower and upper support surfaces 15, 16 and between upper and lower locking surfaces 11*a*, 11*b*. The locking element 8 with its upper locking surface 11*a* at the second edge section 7*b* will only partly snap back to its original position, preferably less than about 80% of the first inward displacement, and will in locked position be displaced upwardly in relation to an unlocked position due to the inclined upper and lower locking surfaces 11*a*, 11*b*. This may increase the locking strength considerably, even in the case when the locking element in locked position is only pressed inwardly about 0.1-0.2 mm.

Figure 7A:
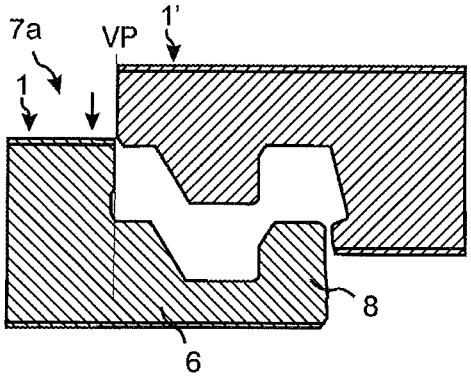
FIGS. 7*a-f* illustrate locking according to a first principle.
Figure 7D:
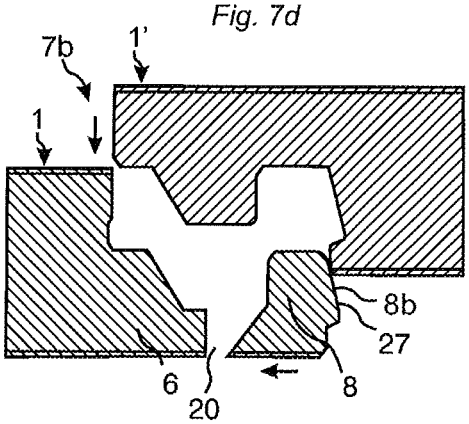
Figure 7B:
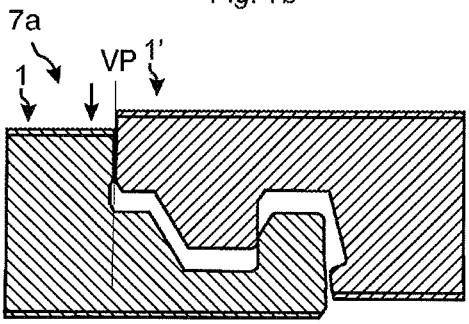
Figure 7E:
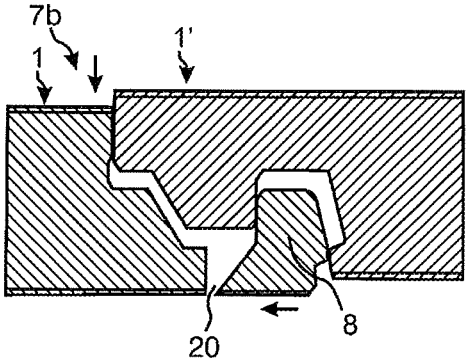
Figure 7C:
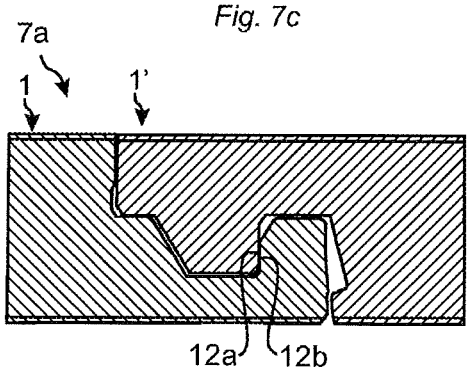

FIGS. 7*a*-7*c* show locking of the first adjacent edge sections 7*a*. The second panel 1' is displaced essentially along a vertical plane VP until the first and second locking surface 12*a*, 12*b* are in contact with each other and a horizontal edge separation is prevented until the edges are in a final locked position.

Figure 7F:
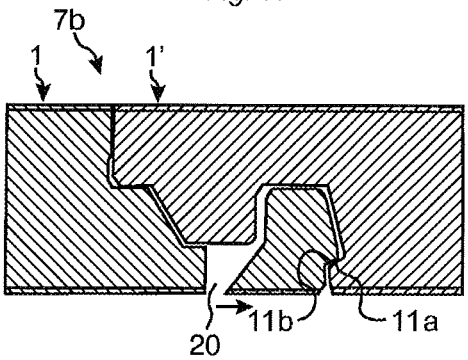

FIGS. 7*d*-7*f* show locking of the second edge section 7*b*. A lower part of the second panel slides against a sliding surface 27 formed on the outer surface 8*b*, which is an outer part of the locking element 8. The separation forces are prevented by the first edge section 7*a* that is in a locking stage with overlapping first and second locking surfaces 12*a*, 12*b*. The locking element 8 adjacent to the slit 20 is pressed inwardly by the lower part of the second panel 1' until the edges are in a final locking position when the locking element 8 snaps back towards its initial position such that the upper 11*a* and the lower 11*b* locking surfaces lock against each other and prevent vertical separation of the adjacent panel edges 1, 1'.

Figure 8A:
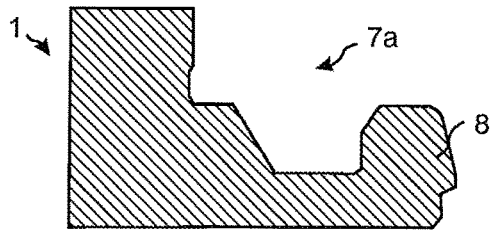
FIGS. 8*a-h* illustrate forming a locking system designed according to the first principle.
Figure 8B:
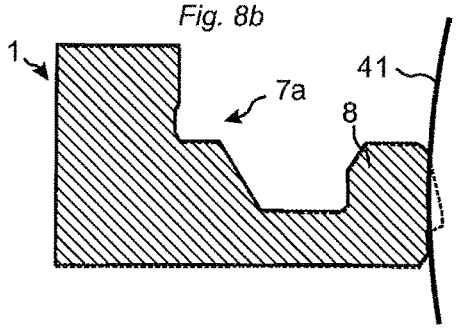
Figure 8C:
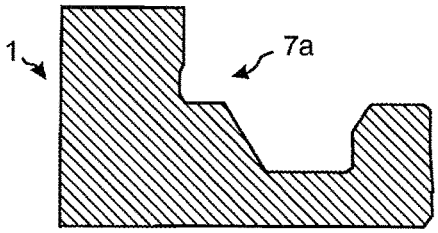

FIGS. 8*a*-8*c* show that a screw cutter 41 may be used to remove the outer part of the locking element 8 from a first panel edge 1 in order to form a part of first edge section 7*a*.

Figure 8G:
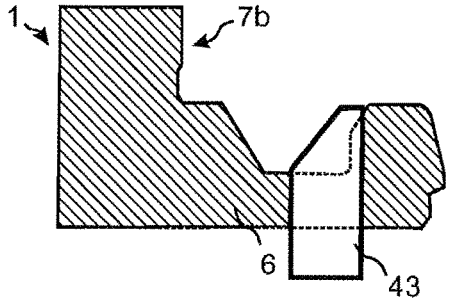
Figure 8D:
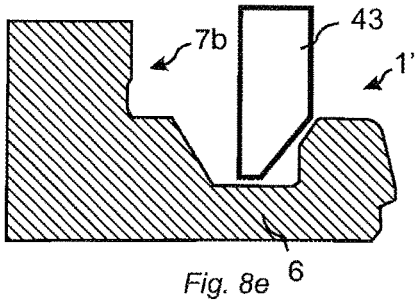
Figure 8E:
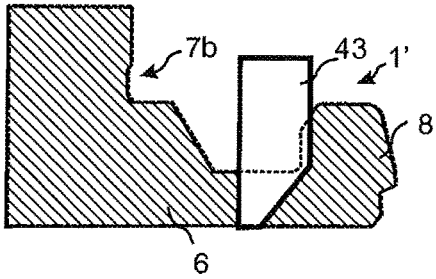
Figure 8F:
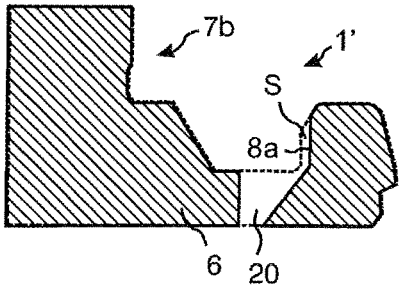

FIGS. 8*d*-8*f* show that a jumping tool 43 may be used to form the second flexible section 7*b* by removing a part of the inner surface 8*a* of the locking element 8 and a part of the strip 6 in order to create a space S and to form a slit 20. The jumping tool is initially positioned above the strip 6.

Figure 8H:
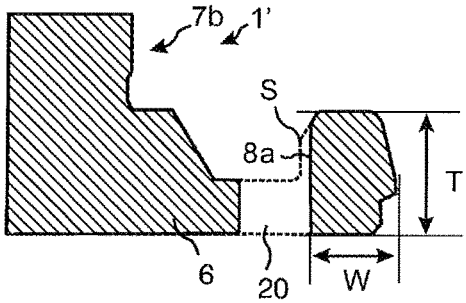
Figure 9A:
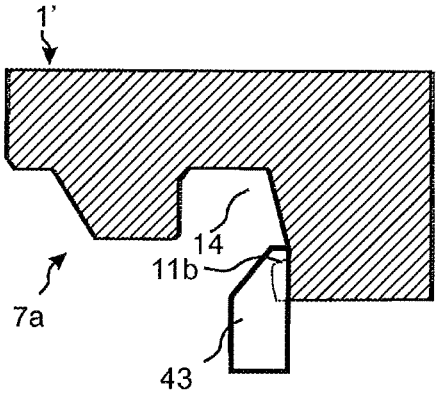
FIGS. 9*a-d* illustrate forming a locking system designed according to the first principle.
Figure 9B:
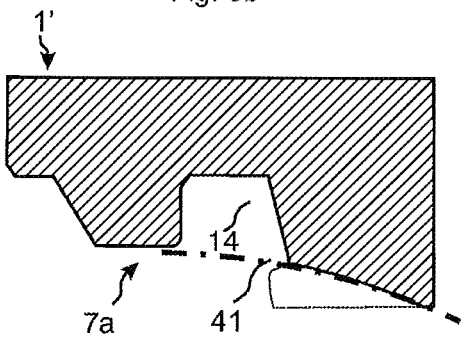
Figure 9C:
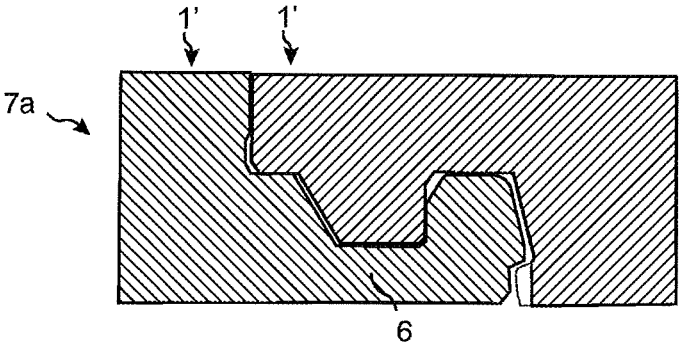
Figure 9D:
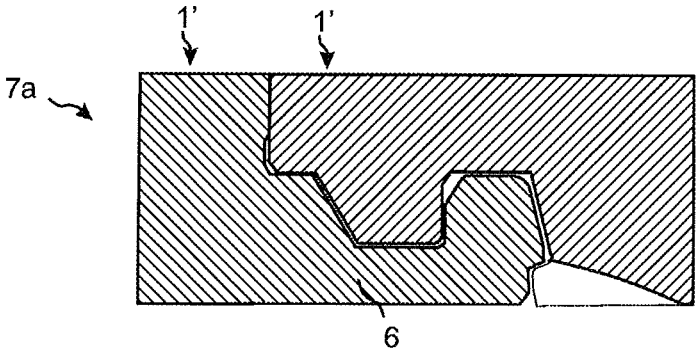

FIGS. 8*g* and 8*h* show that similar removal may be obtained with a jumping tool 43 that initially is positioned below the strip. The difference between these two production methods is mainly the fact that more material is removed at the entrance side where the tool initially is positioned than at the exit side. This may be used to form locking systems with a geometry that may be suitable for a strong vertical locking or a strong horizontal locking and the locking system may be adapted to various material properties of the core material. FIG. 8*h* shows that the thickness T of the flexible locking element 8 may be larger than the width W and such a locking element is easier to bend horizontally inwardly than vertically upwards. Low locking resistance during vertical folding may be combined with a strong vertical locking force in locked position.

FIGS. 9*a*-9*d* show that the first rigid edge section 7*a* may be formed with a jumping tool 43 or a screw cutter 41 that removes a lower part of the locking groove 14 and the lower locking surface 11*b*.

Figures 10A, 10B, 10C, 10D:
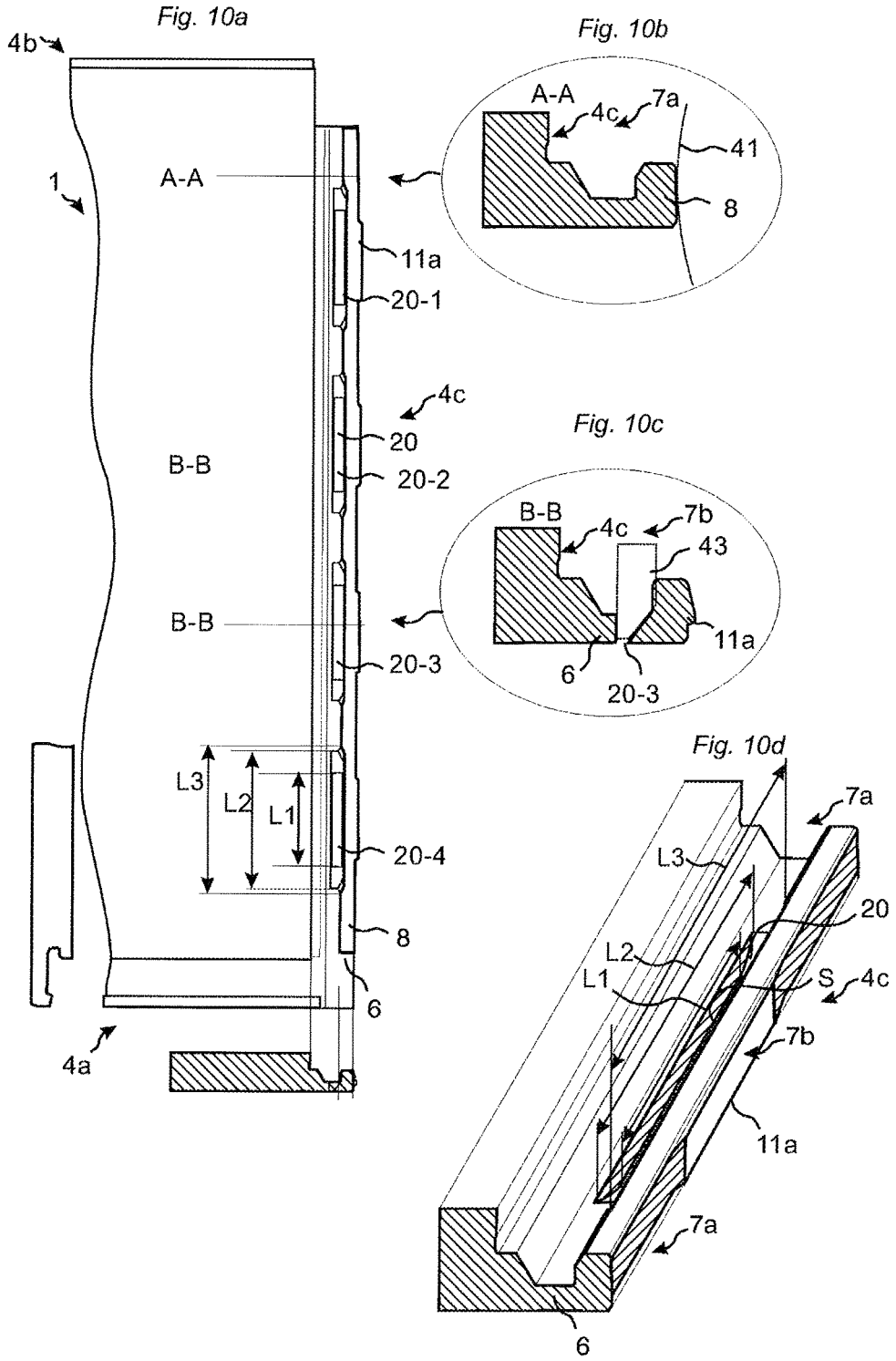
FIGS. 10*a-d* illustrate an edge of a panel comprising a locking system according to an embodiment of the first principle.
Figure 11A:
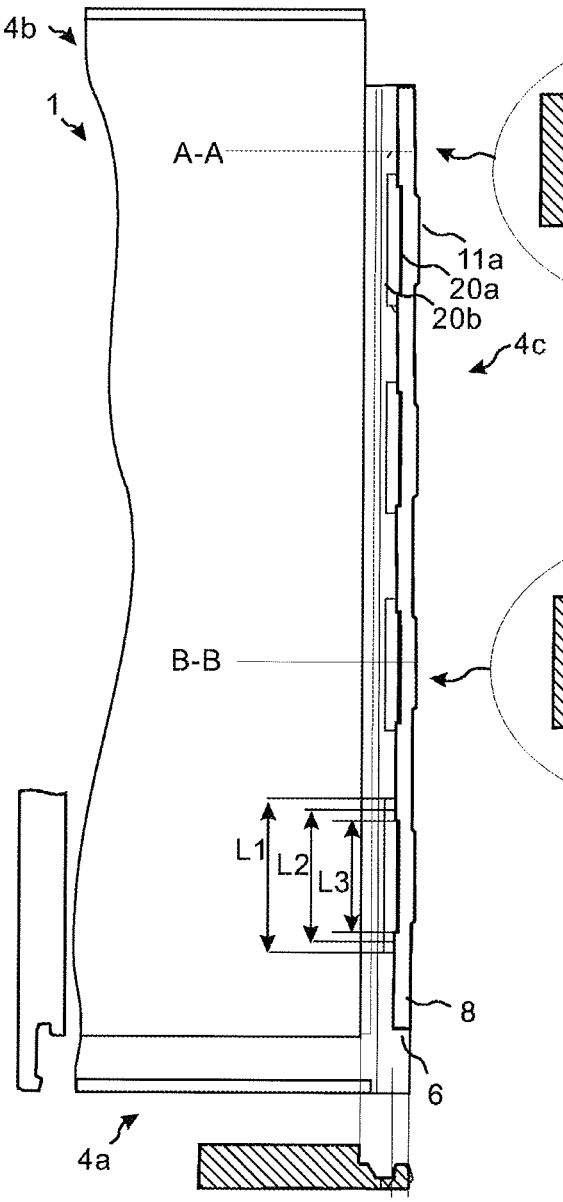
FIGS. 11*a-d* illustrate an edge of a panel comprising a locking system according to an embodiment of the first principle.
Figure 11B:
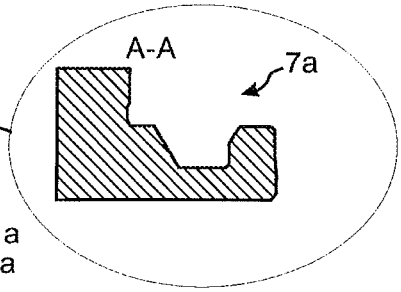
Figure 11C:
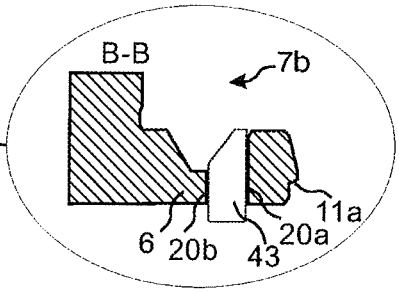
Figure 11D:
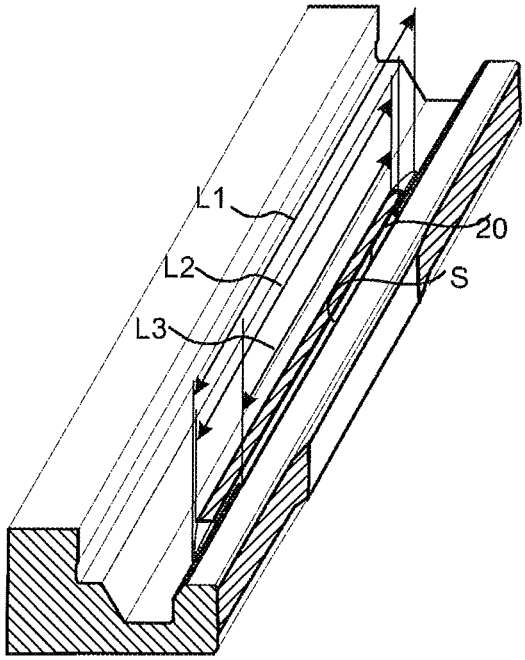

FIGS. 10*a*-10*b* show an embodiment of a first panel 1 comprising two long edges 4*a*, 4*b* and a short edge 4*c*. The panel may be a laminate floor panel comprising an HDF core with a thickness of 6-9 mm. FIG. 10*a* is a plan view of the panel 1. The short edge 4*c* may have a width of about 18-20 cm. Four slits 20-1, 20-2, 20-3, 20-4 may be formed in the strip 6 with a jumping tool head comprising a rotating cutting tool with a diameter of for example 4-10 cm. Such rotating cutting tools may have a sufficient capacity to form slits in high speed especially if the vertical displacement of the cutting tool may be as small as about 3-5 mm. FIG. 10*b* shows a cross section of a part of the first rigid edge section 7*a* that is located between the slits 20-1, 20-2, 20-3, 20-4 along the edge and preferably at the end portions of the strip 6 adjacent to the long edges 4*a*, 4*c*. The outer part of the locking element 8 is removed by a screw cutter 41. FIG. 10*c* shows a cross section of the second flexible edge section 7*b* that comprises a slit 20 and an upper locking surface 11*a*. The shown embodiment comprises five rigid first edge sections 7*a* and four flexible second edge sections 7*b* and this is sufficient to provide a strong vertical and horizontal locking especially when the locking element 8 preferably has a thickness that exceeds the width. It is clear, however, that any number of rigid first edge sections 7*a* and flexible second edge sections 7*b* may be used. FIGS. 10*c* and 10*d* shows that the slit 20-3 may be formed with a jumping tool head 43 that initially is located above the strip 6. According to the present embodiment, a length L2 of an upper part of the slit 20 is larger than a length L1 of the lower part of the slit 20 and a length L3 of the space S. Such joint geometry may be favourable in some core materials and some core thicknesses.

FIGS. 11*a*-11*d* show the same basic embodiment as FIGS. 10*a*-10*d*. The only difference is that the jumping tool 43 is initially located below the strip 6. The length L2 of the upper part of the slit 20 is smaller than the length L1 of the lower part of the slit 20 and the length L3 of the space S.

A slit 20 that may be formed from above and/or from below provides the advantages that relationships between vertical and horizontal locking surfaces and the flexibility of the flexible edge section may be adjusted in an easy way and adapted to the properties of the core material.

Figures 12A, 12B, 12C:
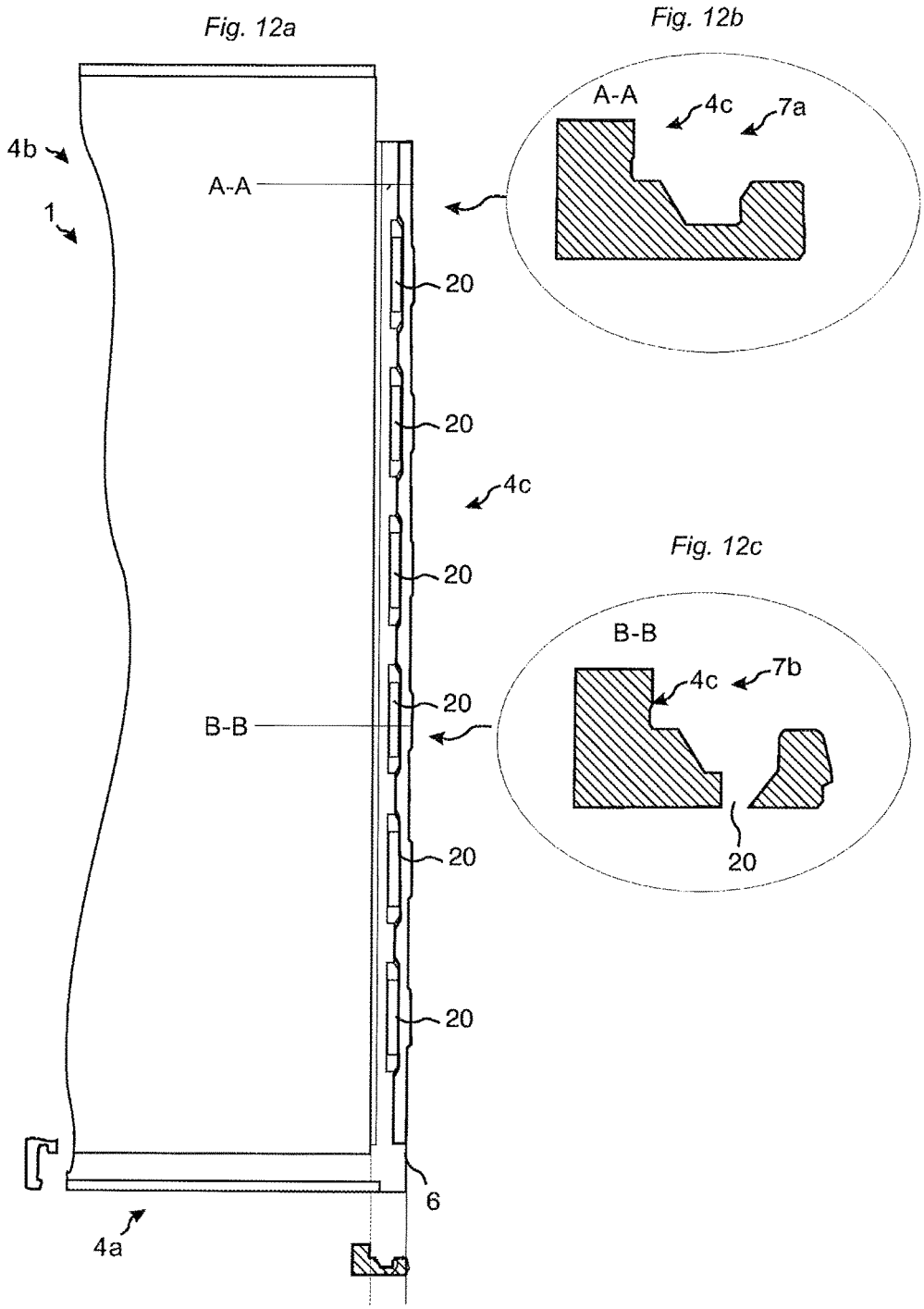
FIGS. 12*a-c* illustrate an edge of a panel comprising a locking system according to an embodiment of the first principle.

FIGS. 12*a*-12*c* show a panel that may be a LVT or WPC floor panel having a core comprising thermoplastic material and fillers with a thickness of about 3-5 mm. The short edge 4*c* may have a width of about 18-20 cm. The small thickness makes it possible to form more than four slits in the strip 6 with a jumping tool head, for example six slits as shown in FIG. 12*a*. The shown non-limiting embodiment may comprise preferably up to seven rigid first edge sections 7*a* and up to six flexible second edge sections 7*b* and this is sufficient to provide a strong vertical and horizontal locking over essentially the whole short edge 4*c* in thin core material.

Figure 13A:
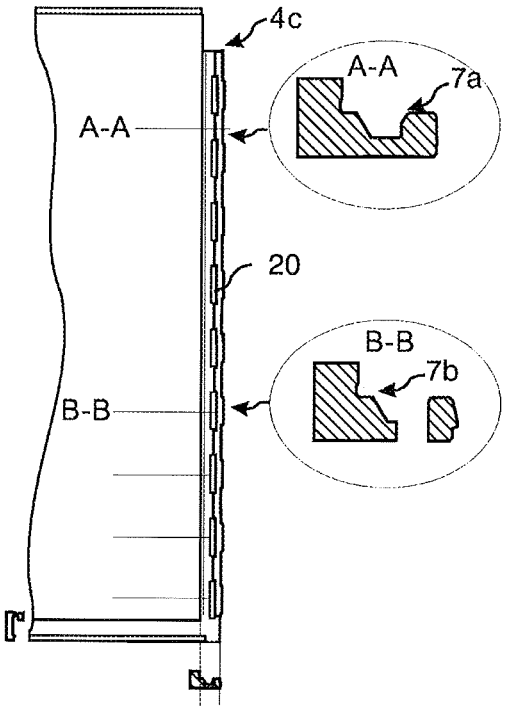
FIGS. 13*a-c* illustrate an edge of a panel comprising a locking system according to an embodiment of the first principle that is formed with punching.
Figure 13B:
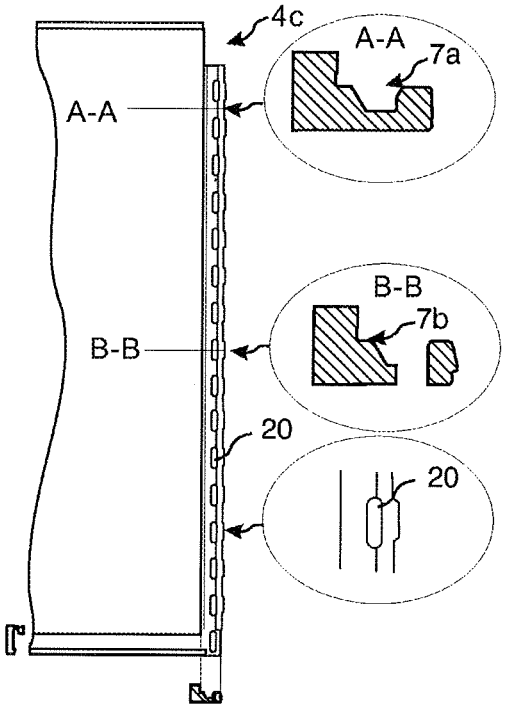
Figure 13C:
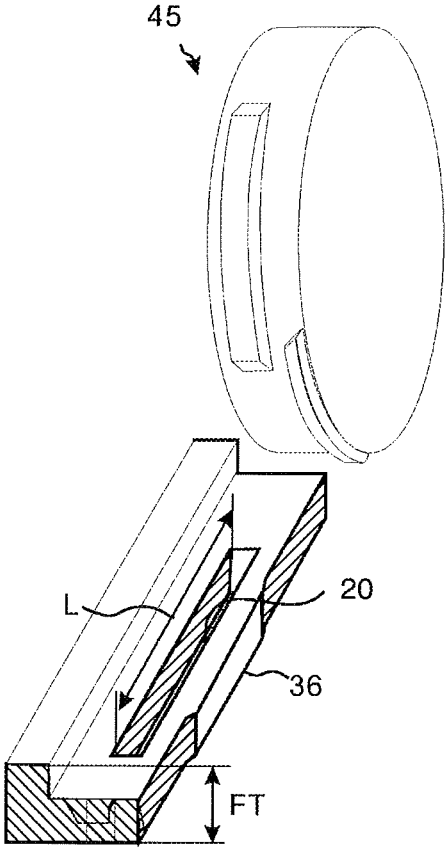

FIGS. 13*a*-13*c* show that the number of sections 7*a*, 7*b* may be increased further if a punching wheel 45 is used that may remove material such that the slits 20 and protrusions 36 may be formed with essentially vertical walls and with advanced geometries. Such forming is especially suitable for floor panels comprising a core of thermoplastic material such as LVT and WPC core material. Such a locking system may comprise a slit 20 with a length L that is smaller than 2-3 times the floor thickness FT. A short edge may comprise more than ten slits 20.

Figure 14A:
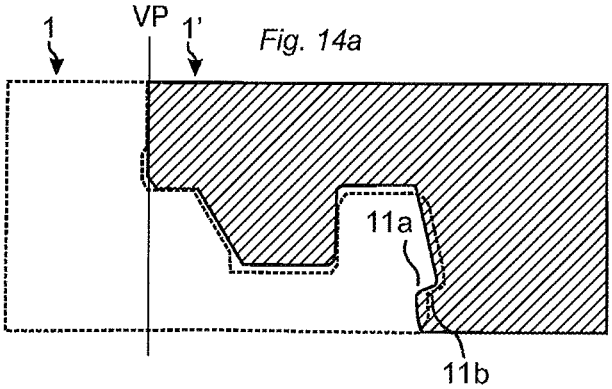
FIGS. 14*a-g* illustrate an embodiment of a locking system according to a second principle of the invention.
Figure 14B:
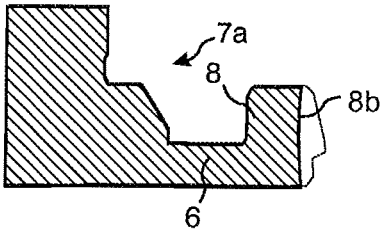
Figure 14C:
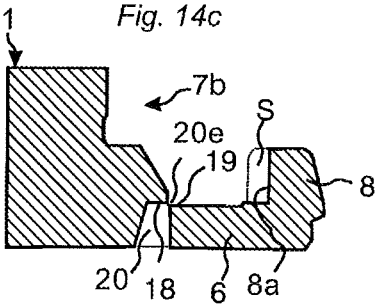
Figure 14D:
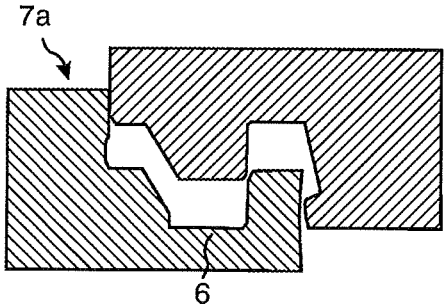
Figure 14E:
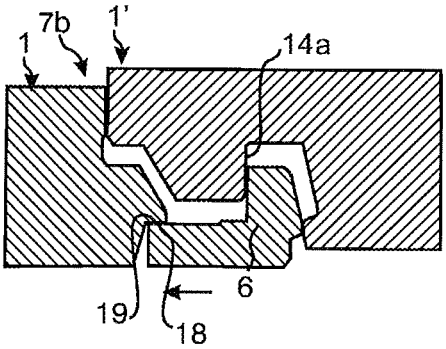
Figure 14F:
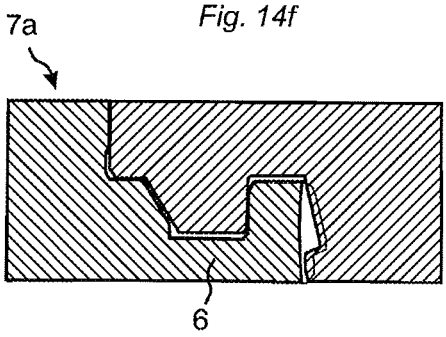
Figure 14G:
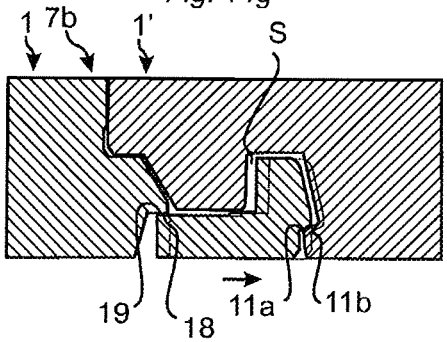

FIGS. 14*a*-14*g* show a second principle of the invention. A locking system is initially formed with a geometry that is not possible to lock even when the edges are displaced sideways along the joint since the horizontal distance from the vertical plane VP to the upper locking surface 11*a* is larger than the distance from the vertical plane VP to the lower locking surface 11*b* as shown in FIG. 14*a*. Material is thereafter removed from the locking element 8 as in the first principle. According to the present embodiment, the outer surface 8*b* in the first edge section 7*a* has a concave shape so that a horizontal extension of an upper and a lower portion of the locking element from the vertical plane VP is larger than a horizontal extension of a middle portion of the locking element between the upper and lower portion. Alternatively, however, the outer surface 8*b* may be planar in a vertical direction. Moreover, a slit 20 is formed in the second edge section 7*b*, preferably with a very small opening 20*e* that may be as small as for example 0.05-0.5 mm, e.g. 0.1 mm, or practically even non-existent as long as material above the slit may be separated. FIGS. 14*d*, 14*f* show that the first edge section 7*a* is locked in a similar way as shown in FIGS. 7*a*-7*c*. The upper part of the slit 20 comprises an upper stabilizing surface 18 and the upper part of the strip 6 comprises a lower stabilizing surface 19 as shown in FIG. 14*e*. In an unlocked position of the panels 1, 1', the upper stabilizing surface 18 is provided inwardly of the lower stabilizing surface 19. The flexible part of the strip 6 is during locking displaced inwardly and the stabilizing surfaces 18, 19 will overlap each other horizontally as shown in FIG. 14*e*. The flexible part of the strip 6 will during the final stage of the vertical displacement slide back partly towards its initial position but not completely until the upper 11*a* and lower 11*b* locking surfaces are in contact with each other and the locking system will be locked with a horizontal pretension and with overlapping upper 18 and lower 19 stabilizing surfaces. There is a space S provided in the second flexible edge section 7*b* into which the locking element is displaced during locking. In a locked position of the panels 1, 1', the space is provided between an inner surface 8*a* of the locking element 8 and an outer groove wall 14*a* of the locking groove 14. For example, the space S may be formed by removal of material.

As shown in FIG. 1*b* the bending of a flexible tongue is at its maximum position in the middle portion P3 where the vertical locking strength is low and this middle section may be stabilized with stabilizing surfaces that may overlap each other with for example 0.1-0.5 mm. This is sufficient to stabilize a flexible part formed by a slit 20.

Stabilizing surfaces allow that the length of the slit may be increased and in some applications only one or two slits may be sufficient.

Figure 15A:
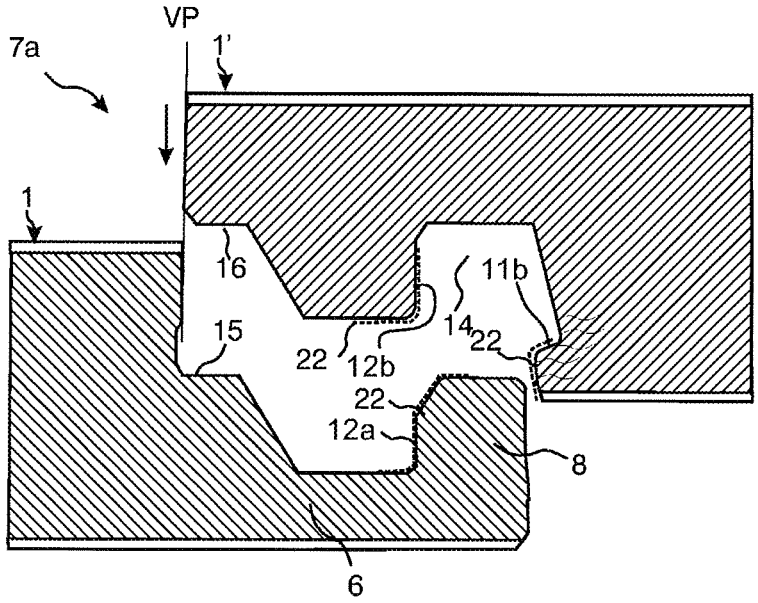
FIGS. 15*a-b* illustrate embodiments with increased locking strength and reduced friction.
Figure 15B:
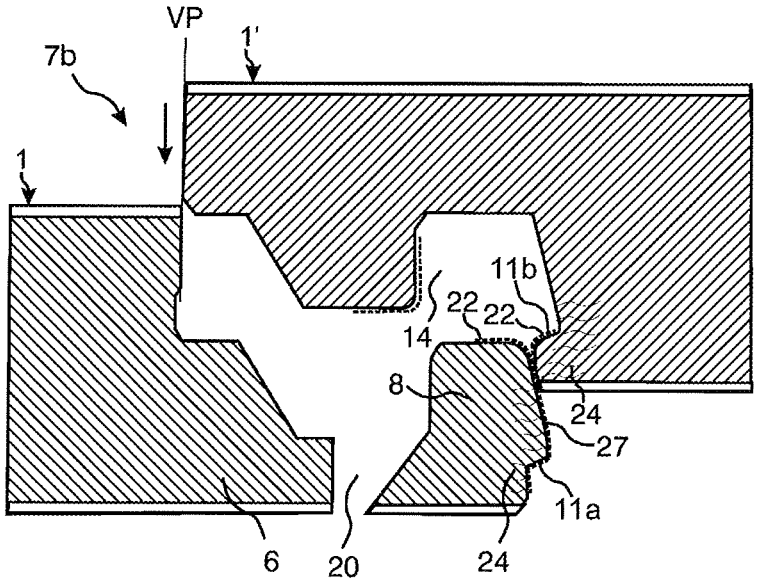

FIGS. 15*a* and 15*b* show that a wax layer 22 may be applied on all parts that are in contact with each other, especially on surfaces adjacent to the upper 11*a* and lower 11*b* locking surfaces for example the sliding surface 27 and on first 12*a* and second 12*b* locking surfaces. This may reduce friction forces during locking. Core material adjacent to the upper and lower locking surfaces 11*a*, 11*b* may also be reinforced with for example resins that are injected into the core or applied on the contact surfaces. The present embodiment may be combined with all principles in the disclosure.

Figure 16A:
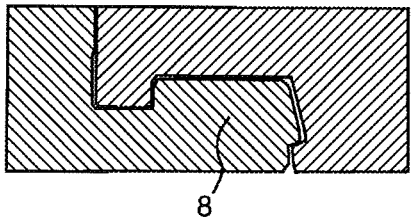
FIGS. 16*a-f* illustrate an embodiment of a locking system according to a third principle of the invention.
Figure 16D:
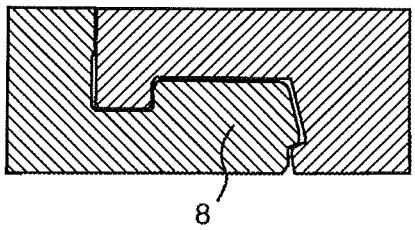
Figure 16B:
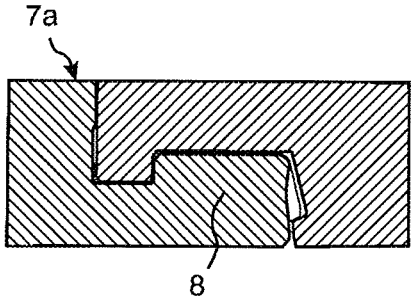
Figure 16E:
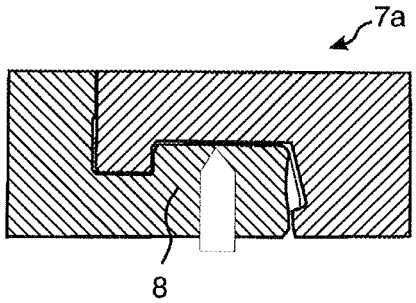
Figure 16C:
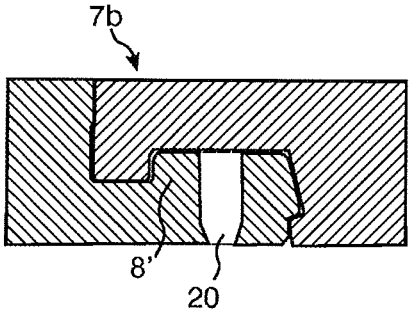
Figure 16F:
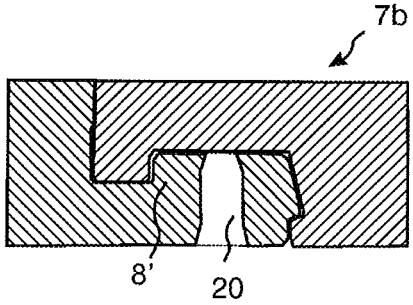

FIG. 16*a*-16*f* show an embodiment of a locking system according to a third principle of the invention. Such a locking system may be used when a high horizontal strength is needed for example in a floating floor that is installed in a large commercial area. The slit 20 may be formed in the locking element 8 and the first and the second edge section 7*a*, 7*b* may comprise a rigid locking element 8' that is continuous and that extends essentially along the whole edge. FIG. 16*c* shows a slit 20 that is formed with a jumping tool from above and FIG. 16*f* shows a slit 20 that is formed from below. Punching may also be used. The present embodiment may be combined with all principles in the disclosure.

Figure 17A:
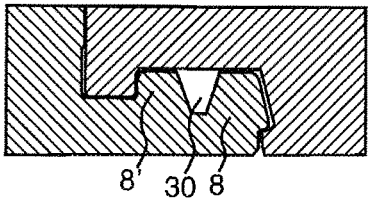
FIGS. 17*a-g* illustrate an embodiment of a locking system according to the third principle of the invention.
Figure 17D:
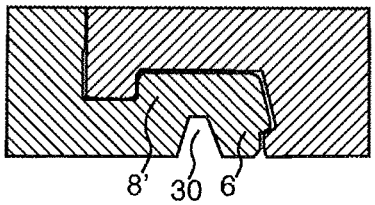
Figure 17B:
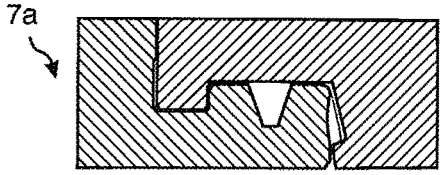
Figure 17E:
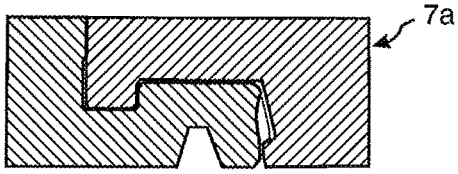
Figure 17C:
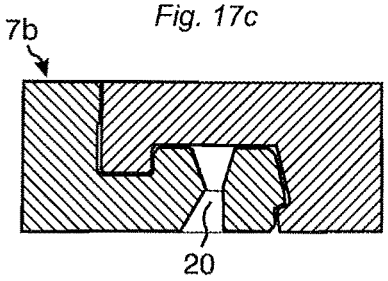
Figure 17F:
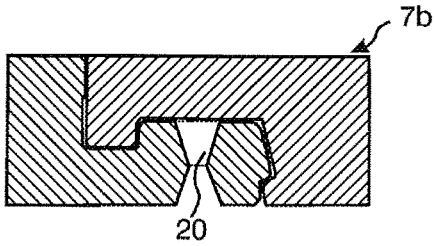
Figure 17G:
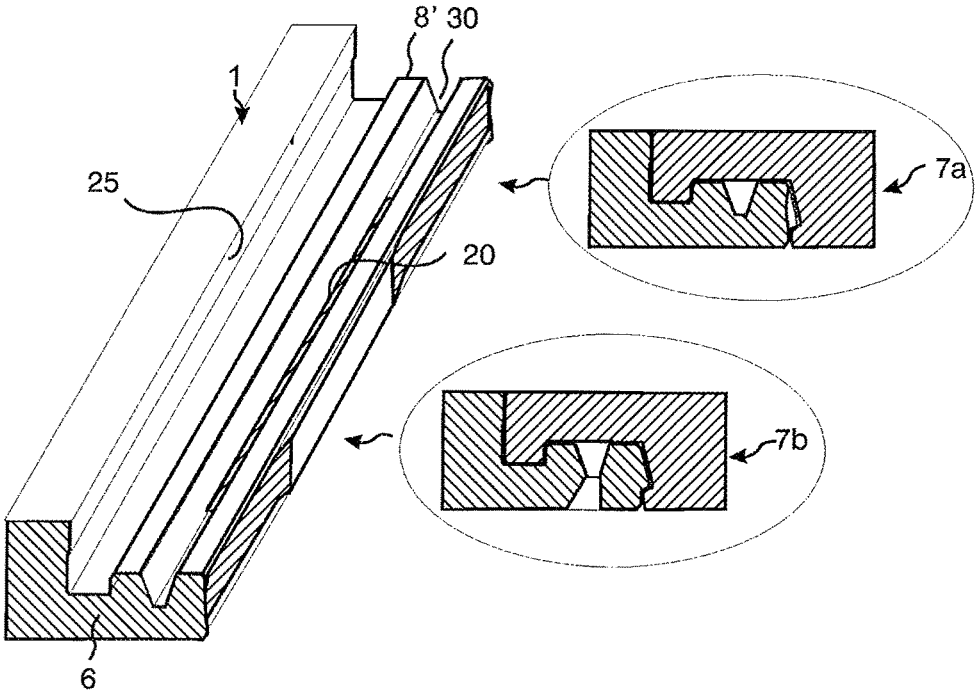

FIGS. 17*a*-17*c* show that a preformed groove 30 may be formed along essentially the whole locking element 8 and a slit 20 may be formed from below in the second edge section. FIGS. 17*d*-17*f* show that the preformed groove may be formed in the lower part of the strip 6 and the slit 20 may be formed from above the locking element. FIG. 17*g* shows an edge of a first panel 1 comprising a continuous locking element 8' located between the slit 20 and the upper edge 25 of the first panel 1. According to alternative embodiments (not shown) the preformed groove 30 may extend along a part of the locking element 8. In a first non-limiting example, an extension of the preformed groove 30 is the same or larger than an extension of the slit 20. In a second non-limiting example, the preformed groove 30 extends side by side with the slit 20. The present embodiment may be combined with all principles in the disclosure.

FIGS. 18*a*-18*d* show a locking system according to a fourth principle of the invention. The strip 6 in the first panel 1 comprises a first 8 and a second 8' upwardly protruding locking element. The first locking element 8 is located closer to the upper edge 25 of the first panel 1 than the second locking element 8'. The edge of the second panel 1' comprises a downwardly extending protrusion 36*a*. The downwardly extending protrusion 36*a* is provided outside of a locking groove 14 provided in the second panel 1'. The locking groove 14 is configured to engage with the second locking element 8' in a locked position of the panels 1, 1'. An upper locking surface 11*a* is formed in an upper and outer part of the first locking element 8 and a lower locking surface 11*b* is formed at a lower and outer part of the protrusion 36*a*.

Figure 18A:
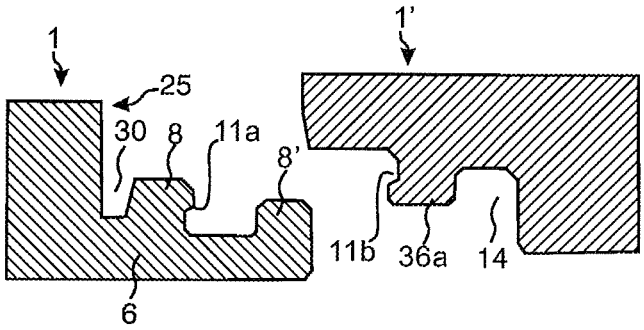
FIGS. 18*a-d* illustrate an embodiment of a locking system according to a fourth principle of the invention.
Figure 18B:
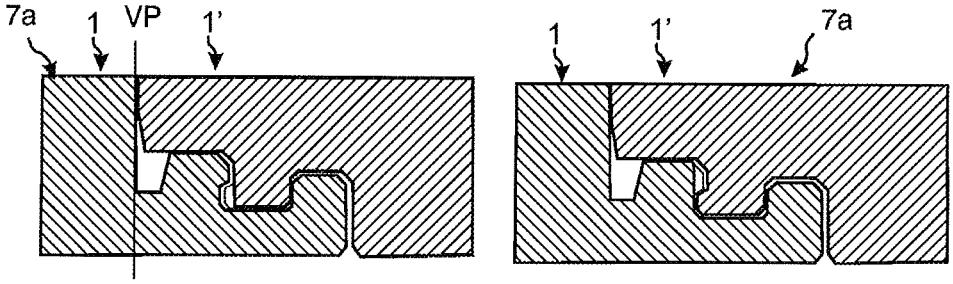
Figure 18C:
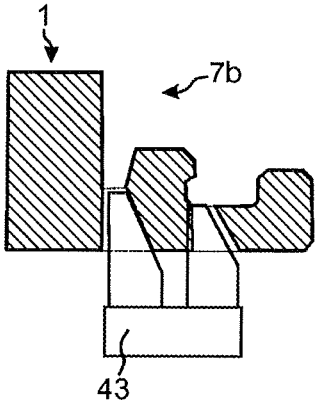
Figure 18D:
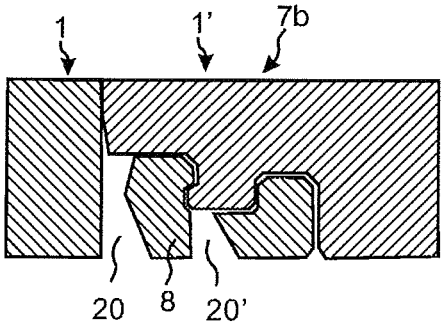

There is provided a first rigid edge section 7*a* and a second flexible edge section 7*b* along the edges of the first 1 and second 1' panels. The first 7*a* and second 7*b* edge sections may be arranged according to any of the embodiments described in the above. FIG. 18*b* shows that the first rigid edge section 7*a* may be formed such that the upper 11*a* or the lower 11*b* locking surface is removed. The second edge section 7*b* may be formed with a jumping tool 43 or punching. FIGS. 18*c* and 18*d* show the second edge section 7*b* that comprises a first and a second slit 20, 20' located horizontally side-by-side. The first slit 20 is located closer to the upper edge 25 of the first panel 1 than the second slit 20'. The slits allow the first locking element 8 and the upper locking surface 11*a* to be displaced inwardly during locking. The locking system is configured to be locked with a vertical displacement of the second edge against the first edge wherein a part of the first locking element 8 and a slit wall of the first and the second slits during an initial stage of the vertical displacement is configured to bend horizontally inwards towards an inner part of the first panel 1 and during a final stage of the vertical displacement is configured to bend outwards towards an initial position of the part of the first locking element 8.

Preferably, a preformed groove 30 is formed adjacent to the vertical plane VP that intersects the upper edge 25 of the first panel edge 1.

Figure 19A:
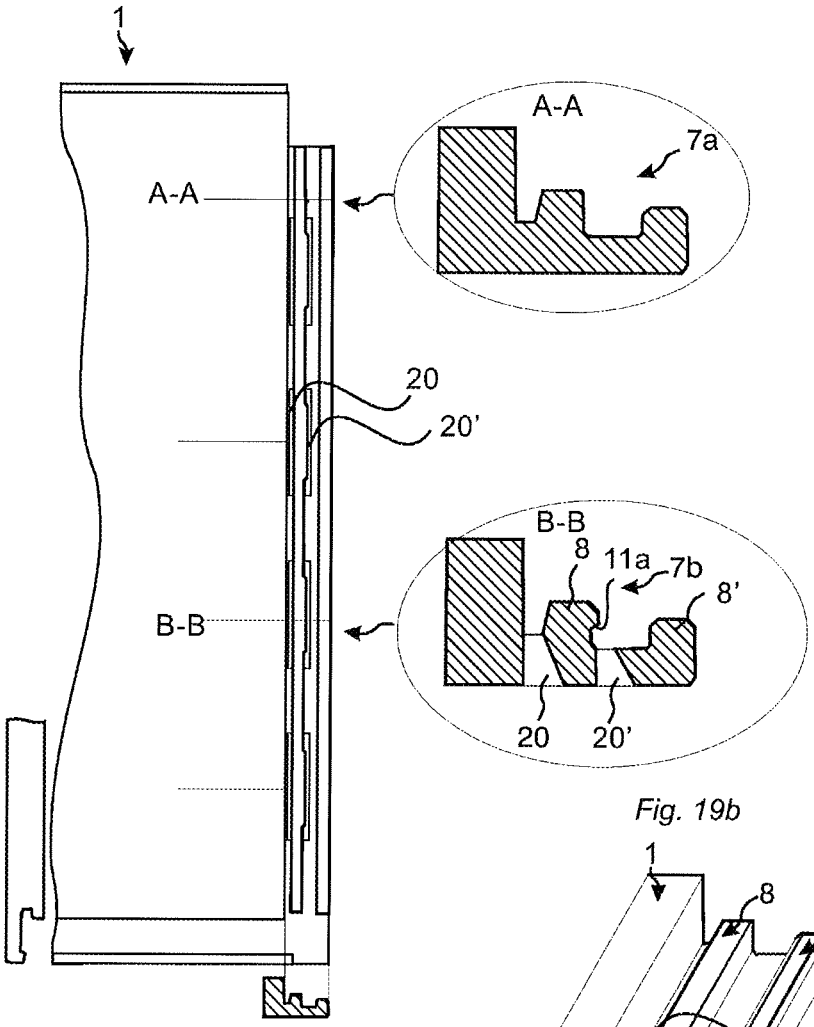
FIGS. 19*a-b* illustrate an embodiment of a locking system according to the fourth principle of the invention.
Figure 19B:
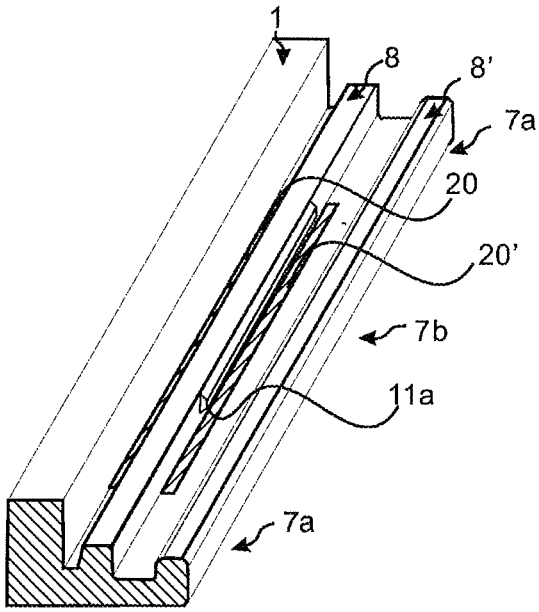
Figure 20A:
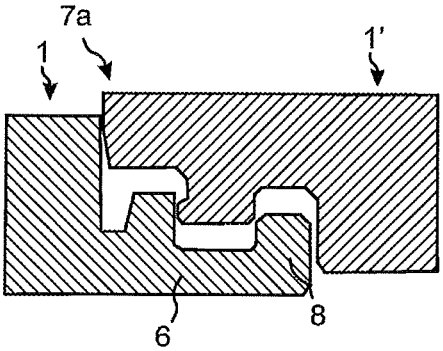
FIGS. 20*a-f* illustrate an embodiment of a locking of a locking system according to the fourth principle of the invention.
Figure 20D:
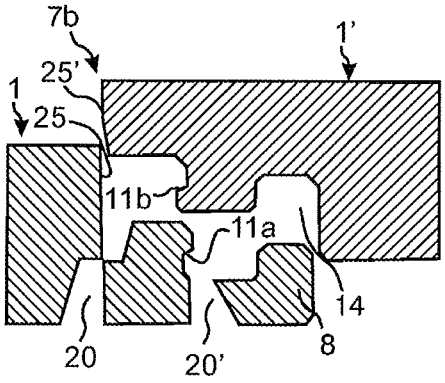
Figure 20B:
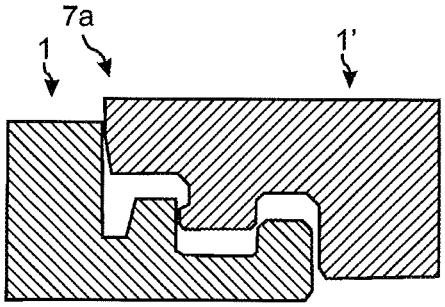
Figure 20E:
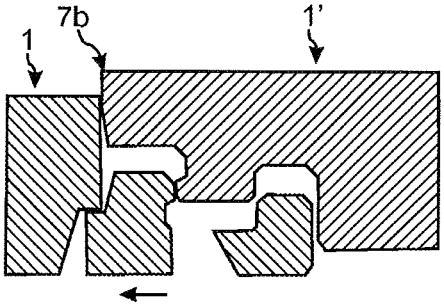
Figure 20C:
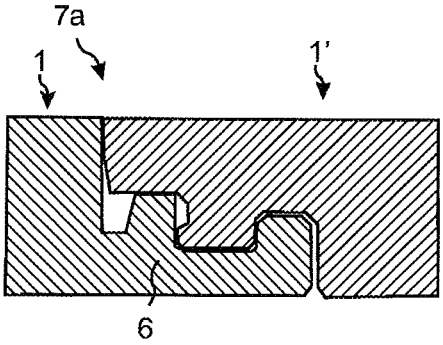
Figure 20F:
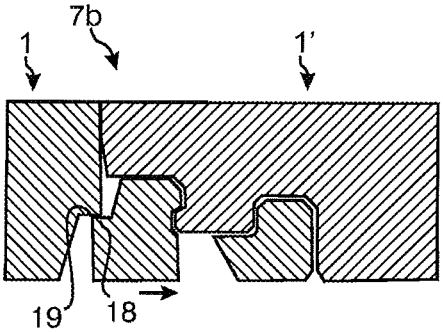

FIGS. 19*a*, 19*b* show a plan and perspective view of a short edge of a first panel 1 comprising a locking system according to the fourth principle of the invention. According to this embodiment, there are a five first rigid edge sections 7*a* and four second flexible edge sections 7*b* provided alternately along the edge of the first panel 1. The first 7*a* and second 7*b* edge sections are illustrated in cross-section along a line A-A and a line B-B, respectively, in the enlargements in FIG. 19*a*. FIG. 19*b* illustrates a perspective view of a second edge section 7*b*. The first 20 and the second 20' slits are provided along portions of the edge of the first panel 1. According to the present embodiment, the first 20 and the second 20' slits are provided side by side and have substantially the same extension along the edge, but it is understood that according to alternative embodiments they may have different extensions. In a first example, the first slit 20 has a longer extension than the second slit 20' along the edge. In a second example, the first slit 20 has a smaller extension than the second slit 20' along the edge.

FIGS. 20*a*-20*f* show that the principles of the invention may be combined, for example the fourth and the second principle. The upper locking surface 11*a* is formed in an edge of a first panel 1 and is located above the strip 6 and between the locking element 8 and the upper edge 25 of the first panel 1 and the lower locking surface 11*b* is formed in an edge of a second panel 1' between the locking groove 14 and the upper edge 25' of the second panel 1'. There is provided at least one first rigid edge section 7*a* and at least one second flexible edge section 7*b* along the edges of the first 1 and second 1' panels in accordance with any of the embodiment of the disclosure. The second flexible edge section 7*b* comprises a strip 6 having two slits 20, 20' and the locking is made with pretension and overlapping upper and lower stabilizing surfaces 18, 19 as described above in relation to the second principle of the invention.

Figure 21A:
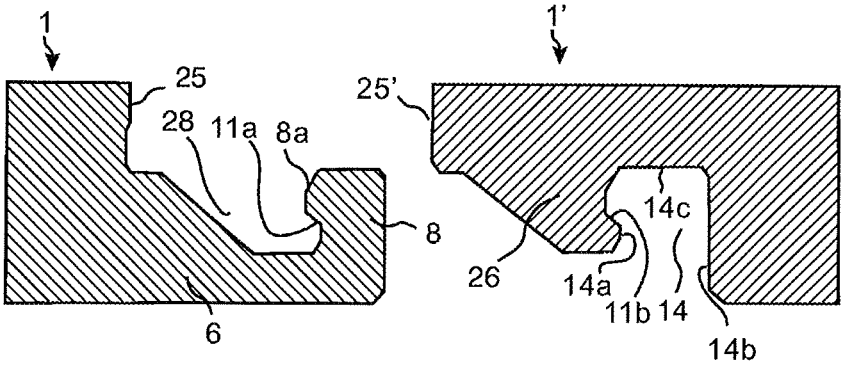
FIGS. 21*a-d* illustrate an embodiment of a locking system according to a fifth principle of the invention.
Figure 21B:
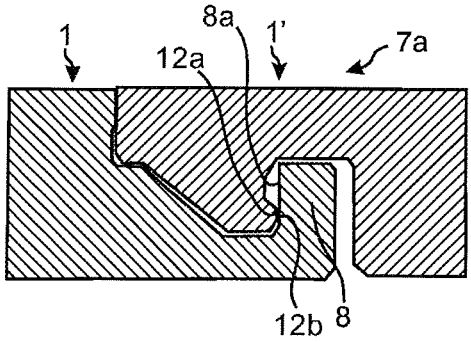
Figure 21C:
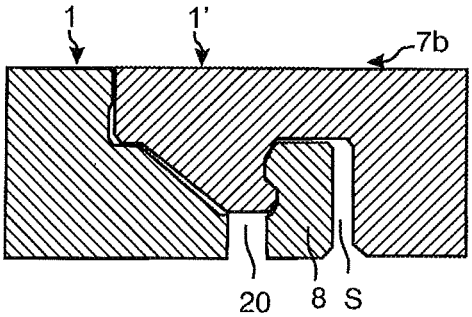
Figure 21D:
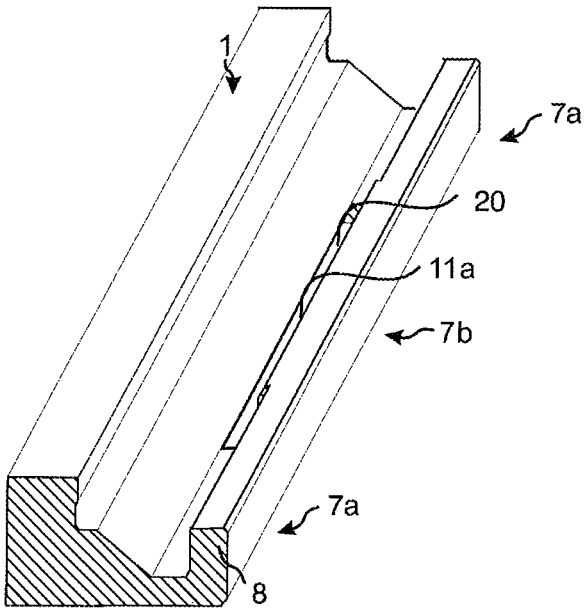

FIGS. 21*a*-21*d* show a locking system of edges of a first 1 and a second 1' panel according to a fifth principle. There is provided at least one first rigid edge section 7*a* and at least one second flexible edge section 7*b* along the edges of the first 1 and second 1' panels in accordance with any of the embodiment of the disclosure. The upper locking surface 11*a* is formed on the inner surface of the locking element 8 in the second flexible edge section 7*b* and the lower locking surface 11*b* is formed on the outer groove wall 14*a* of the locking groove 14 along the entire edge of the second panel 1'. As shown in FIG. 21*b*, the first rigid edge section 7*a* does not comprise any upper locking surface 11*a* and provides horizontal locking of the panels since the edge of the second panel 1' comprises a projection 26 that is adapted to engage with an indentation 28 in the edge of the first panel 1 in a locked position. More specifically, a first locking surface 12*a* in an inner surface 8*a* of the locking element 8, which is a vertical wall in the first rigid edge section 7*a*, engages with a second locking surface 12*b* in an outer groove wall 14*a* of the locking groove 14, and an upper edge 25 of the first panel 1 engages with an upper edge 25' of the second panel 1' for providing horizontal locking. The upper 11*a* and lower 11*b* locking surfaces provide vertical locking of the panels 1, 1'. A part of the locking element 8 and a slit wall of the slit 20 is during an initial stage of a vertical displacement of the panels 1, 1' configured to bend horizontally outwardly and during a final stage of the vertical displacement configured to bend inwardly towards an initial position of the part of the locking element 8. A space S and a slit 20 are provided in the second flexible edge section(s) 7*b* as shown in FIG. 21*c*. The space S that preferably extends along essentially the whole edge and that allows a horizontal displacement outwardly of the locking element 8 is formed between an inner groove wall 14*b* of the locking groove 14 and the locking element 8 in a locked position of the panels 1, 1'. FIG. 21*d* illustrates a perspective view of the first panel 1 in the first rigid edge section 7*a* and the second flexible edge section 7*b*. The upper 11*a* and lower 11*b* locking surfaces are preferably essentially horizontal and comprises a locking angle against the horizontal plane that is less than 45 degrees, e.g. 10, 15, 20 or 25 degrees. Such locking surfaces are preferably formed with carving tools.

Figure 22A:
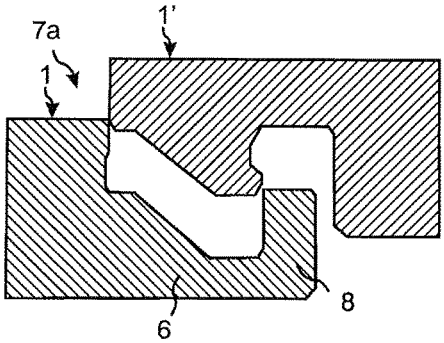
FIGS. 22*a-h* illustrate a locking and a forming of a locking system according to the fifth principle of the invention.
Figure 22D:
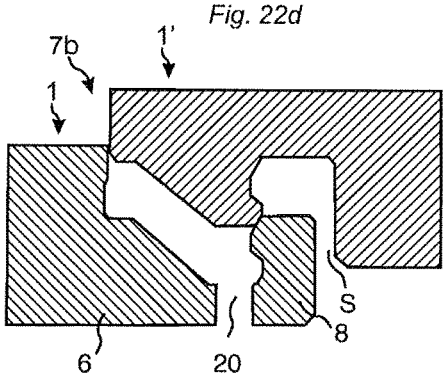
Figure 22B:
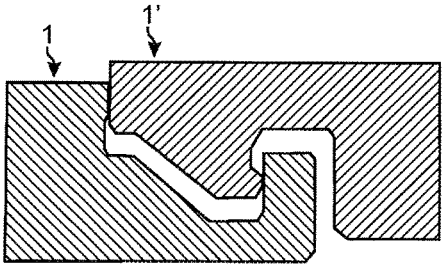
Figure 22E:
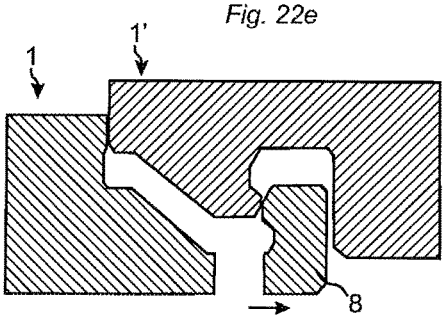
Figure 22C:
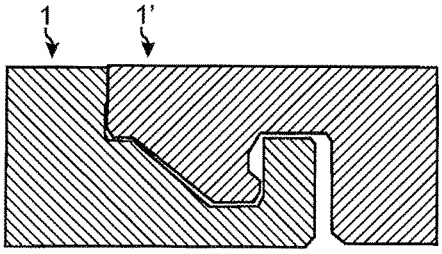
Figure 22F:
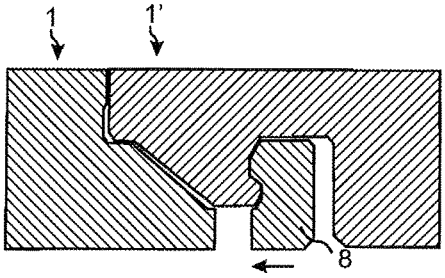
Figure 22G:
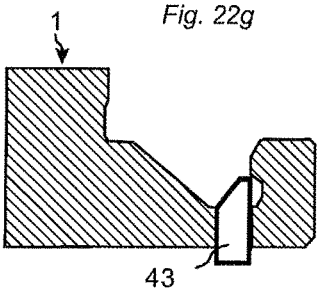
Figure 22H:
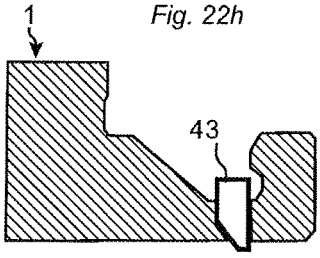

FIGS. 22*a*-22*c* show locking of the first rigid edge section 7*a* and FIGS. 22*d*-22*f* show locking of the flexible second edge section 7*b* when the locking element 8 is initially displaced outwardly, and inwardly during the final stage of the vertical displacement of the edge of the second panel 1' against the edge of the first panel 1. As shown in FIG. 22*e*, the locking element 8 is horizontally displaced outwardly into the space S during locking. FIGS. 22*g* and 22*h* show that the slit 20 may be formed with a jumping tool head from above or below, respectively.

Figure 23A:
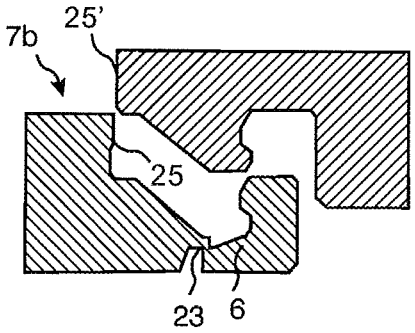
FIGS. 23*a-h* illustrate embodiments according to the fifth principle of the invention.
Figure 23B:
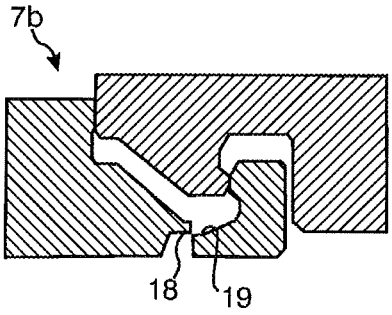
Figure 23C:
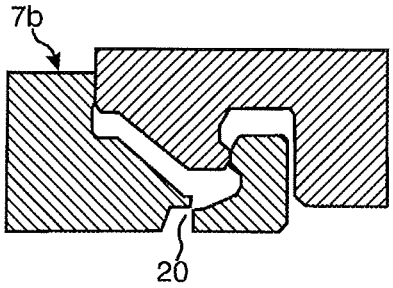
Figure 23D:
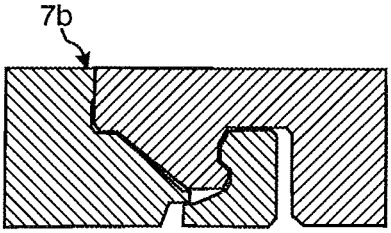
Figure 23E:
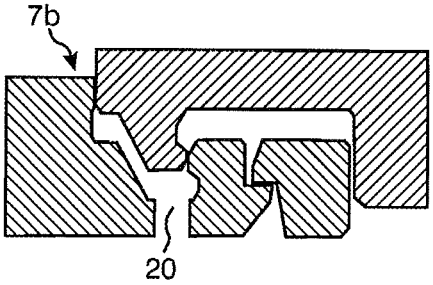
Figure 23F:
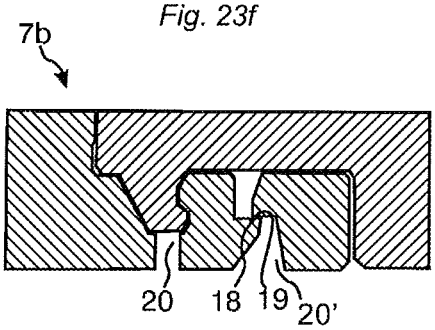
Figure 23G:
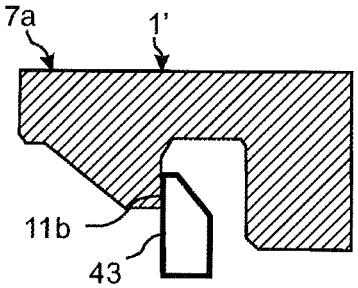
Figure 23H:
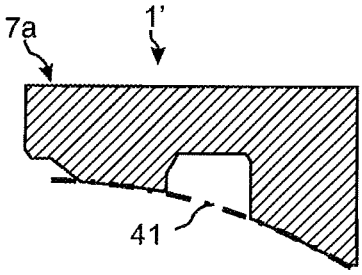

FIGS. 23*a*-23*h* show embodiments of the invention. FIGS. 23*a*-23*d* show that the fifth principle may be combined with the second principle and that a crack 23 in the core material may be used to form upper and lower 18, 19 stabilizing surfaces. In a non-limiting example, the core material may comprise an HDF board that comprises an essentially horizontal fibre orientation. Due to the crack 23, an inner and an outer portion of the strip 6 which initially are joined may be separated during locking when the locking element 8 is displaced outwardly. FIGS. 23*e* and 23*f* show that two slits 20, 20' may be formed in a locking system according to the fifth principle. FIGS. 23*g* and 23*h* show that as an alternative the lower locking surfaces 11*b* may be removed with a jumping tool 43 or a screw cutter 41 in a locking system according to the fifth principle in order to form the rigid first edge section 7*a*. More generally, it is emphasized that embodiments of all the principles of the invention may be combined.

Figure 24A:
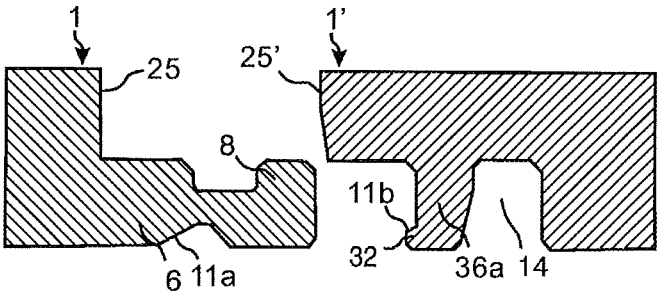
FIGS. 24*a-f* illustrate an embodiment of a locking system according to a sixth principle of the invention.
Figure 24B:
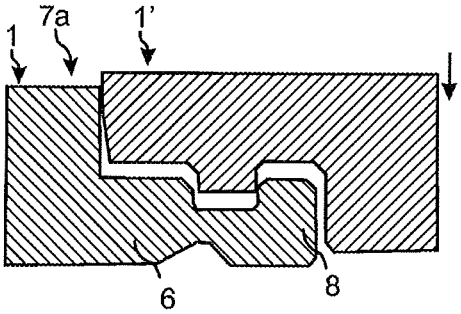
Figure 24D:
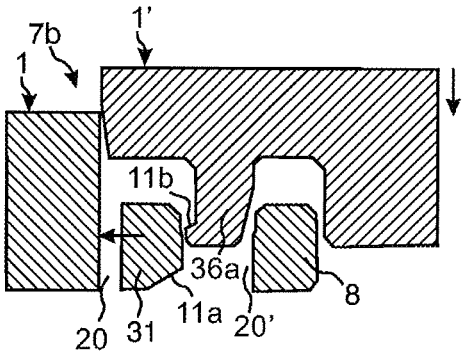
Figure 24C:
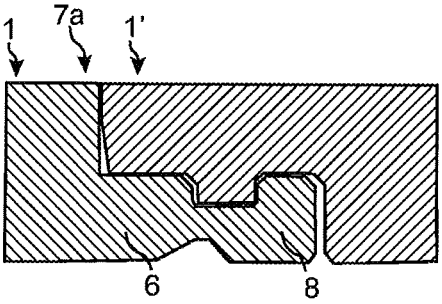
Figure 24E:
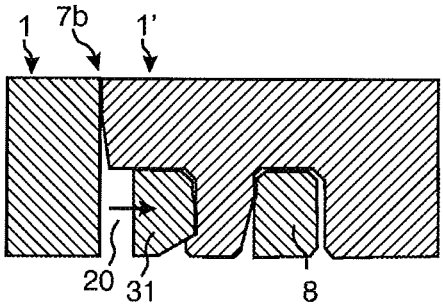
Figure 24F:
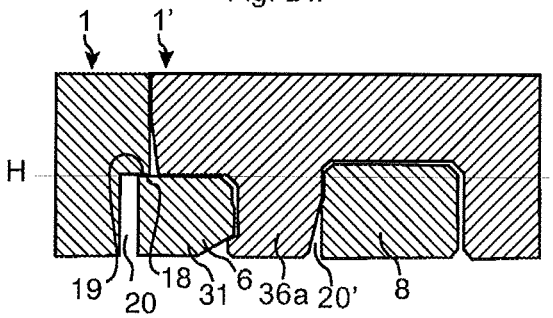

FIGS. 24*a*-24*f* show a sixth principle of the invention. An edge of a first panel 1 comprises a strip 6 with a locking element 8 and an edge of a second panel 1' comprises a downwardly open locking groove 14. The locking element 8 is configured to engage with the downwardly open locking groove 14 in a locked position. Upper 11*a* and lower 11*b* locking surfaces that lock the edge of the first panel 1 to the edge of the second panel 1' vertically are located at a lower part of the strip 6 and at an outer and lower part 32 of an downwardly extending protrusion 36*a*, respectively, wherein the protrusion 36*a* is formed between the locking groove 14 and the upper edge 25' of the second panel 1' as shown in FIG. 24*a*. A part of the protrusion 36*a* and the lower locking surface 11*b* is removed by for example a screw cutter or jumping saw blades and a first rigid edge section 7*a* is formed as shown in FIG. 24*b*. A second flexible edge section 7*b* comprises a first slit 20 and a second slit 20'. The first slit 20 is located closer to the upper edge 25 of the first panel 1 than the second slit 20'. The first slit 20 and the second slit 20' extend along the edge of the second panel 1'. The first 20 and second 20' slit may extend side by side along the edge. An extension of the first slit 20 may be the same as an extension of the second slit 20'. However, it is equally conceivable that the slits have different extensions along the edge as has been explained above in relation to other principles. The upper locking surface 11*a* is located at a lower and inner part of the second slit 20'. The first slit 20 provides flexibility such that a flexible strip part 31 located between the first and the second slit may be displaced horizontally inwardly and back again during locking as shown in FIGS. 24*d* and 24*e*. The second slit 20' is used to accommodate the protrusion 36*a* that during a vertical displacement of the edge of the second panel 1' towards the edge of the first panel 1 is inserted into the second slit such that the upper 11*a* and the lower 11*b* locking surfaces overlap each other and lock the edges of the first 1 and the second 1' panel vertically. FIG. 24*f* show that the sixth principle may be combined with the second principle and that the locking system may comprise a flexible strip part 31 that is locked with pretension and upper and lower stabilizing surfaces 18, 19 that stabilize the flexible strip part 31 and prevent upward bending. The locking system is particularly suitable for thin LVT and WPC floors but may also be used in HDF floors and other floor types. An advantage is that the protrusion 36*a* and the locking element 8 may be strong and rigid since no flexibility of such parts is required to lock the edges with a vertical displacement.

Figure 25A:
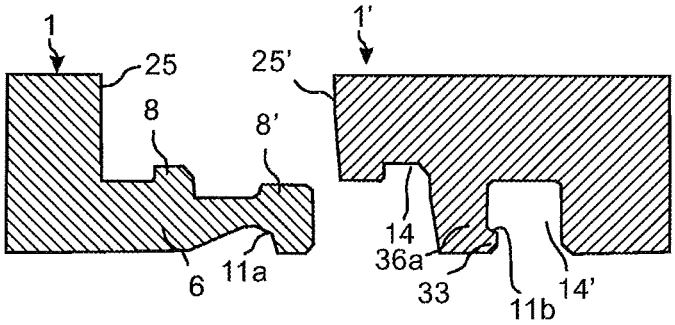
FIGS. 25*a-f* illustrate an embodiment a locking system according to a seventh principle of the invention.
Figure 25B:
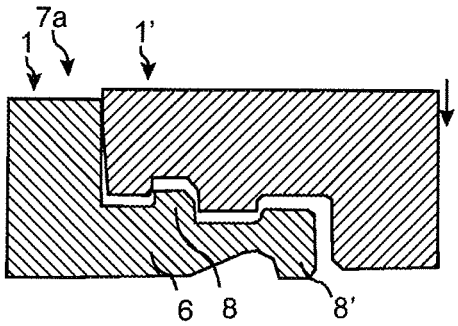
Figure 25D:
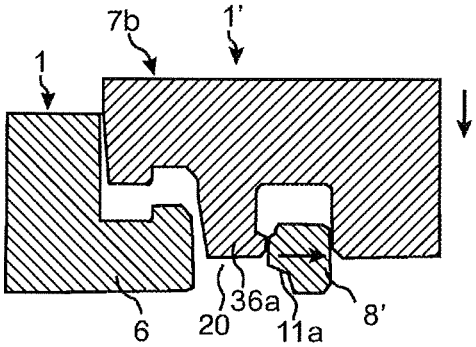
Figure 25C:
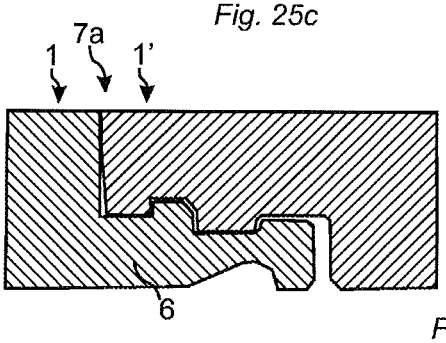
Figure 25E:
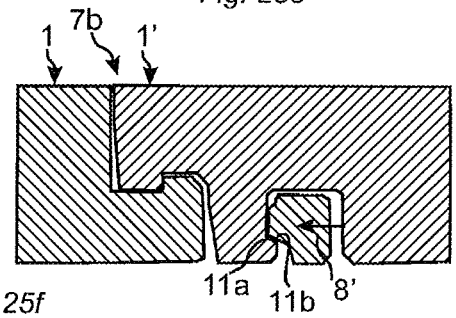
Figure 25F:
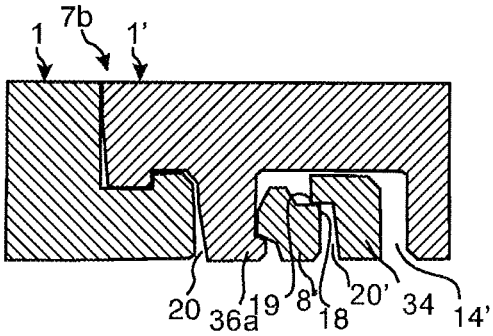

FIGS. 25*a*-25*f* show a seventh principle of the invention that is a modification of the sixth principle. An edge of a first panel 1 comprises a strip 6 with a first 8 and a second 8' locking element 8. The first locking element 8 is located closer to the upper edge 25 of the first panel 1 than the second locking element 8'. An edge of a second panel 1' comprises a first downwardly open locking groove 14 and a second downwardly open locking groove 14'. The first locking groove 14 is located closer to the upper edge 25' of the second panel 1' than the second locking groove 14'. The first locking element 8 and the first locking groove 14 lock the edges horizontally in a locked position of the panels 1, 1'. An upper locking surface 11*a* is located at a lower and inner part of the second locking element 8' and a lower 11*b* locking surface is located at a lower and inner part 33 of a downwardly extending protrusion 36*a* formed on an edge of the second panel 1' between the first 14 and the second 14' locking groove. The upper 11*a* and lower 11*b* locking surfaces lock the edges vertically in a locked position of the panels 1, 1'. A part of the protrusion 36*a* and the lower locking surface 11*b* is removed by for example a screw cutter or jumping saw blades and a first rigid edge section 7*a* is formed as shown in FIG. 25*b*. A second flexible edge section 7*b* comprises a slit 20 that provides flexibility such that the second locking element 8' may be displaced horizontally outwardly and at least partly back again during locking as shown in FIGS. 25*d* and 25*e*. The slit 20 is used to provide flexibility and to accommodate the protrusion 36*a* that during a vertical displacement of the edge of the second panel 1' towards the edge of the first panel 1 is inserted into the slit 20 such that the upper 11*a* and the lower 11*b* locking surfaces overlap each other and lock the edges of the first 1 and the second 1' panel vertically. FIG. 25*f* shows that the seventh principle may be combined with the second principle as shown in FIG. 23*e* and the locking system may comprise a flexible outer stabilizing strip part 34 and a second locking element 8' that is locked with pretension against the protrusion 36*a* such that upper and lower stabilizing surfaces 18, 19 overlap each other.

Figure 26A:
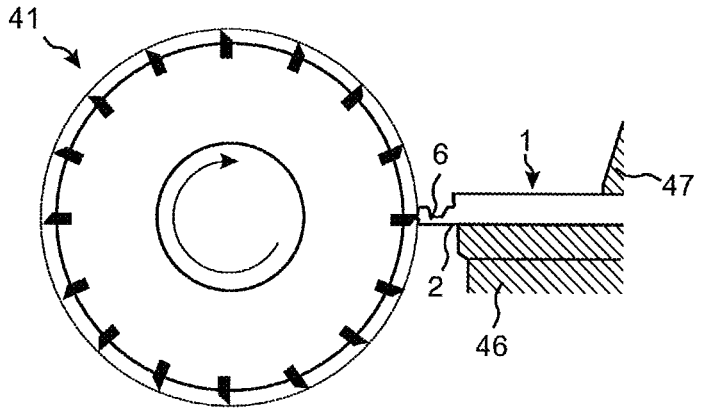
FIGS. 26*a-d* illustrate forming of locking systems with screw cutters, jumping tools, rotating tools and carving according to an embodiment of the invention.
Figure 26B:
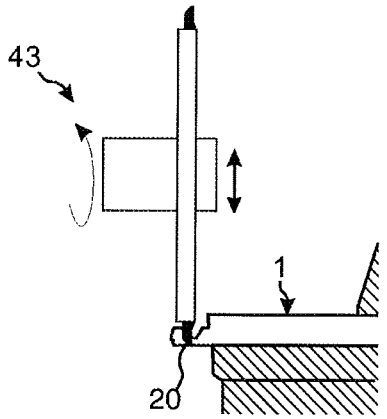
Figure 26C:
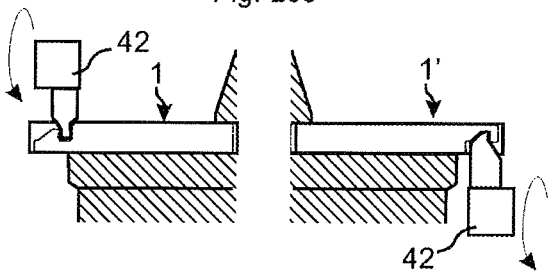
Figure 26D:
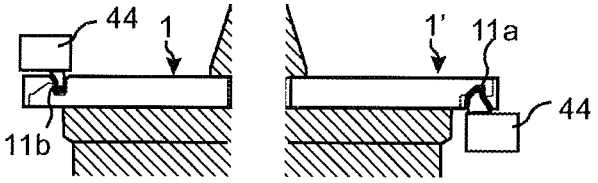

FIG. 26*a* shows an edge of a first panel 1 that is positioned between a chain 46 and a belt 47 of a double-end tenor with its surface 2 pointing downwards. A screw cutter 41 may be used to remove material at an outer part of a strip 6. FIG. 26*b* shows a jumping tool 43 that is used to form slits 20. FIG. 26*c* shows rotating tools 42 that are used to form vertical grooves from above and below and FIG. 26*d* shows that essentially horizontal upper 11*a* and lower 11*b* locking surfaces may be formed with carving tools 44 in the vertical grooves formed by rotating tools.

Figure 27A:
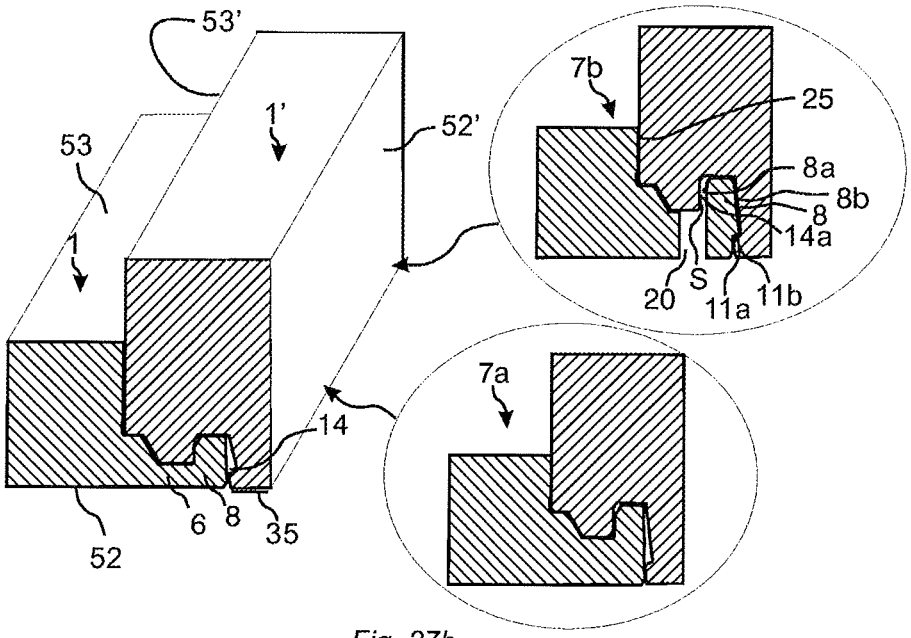
FIGS. 27*a-b* illustrate an embodiment of a locking system for furniture components according to an eighth principle of the invention.
Figure 27B:
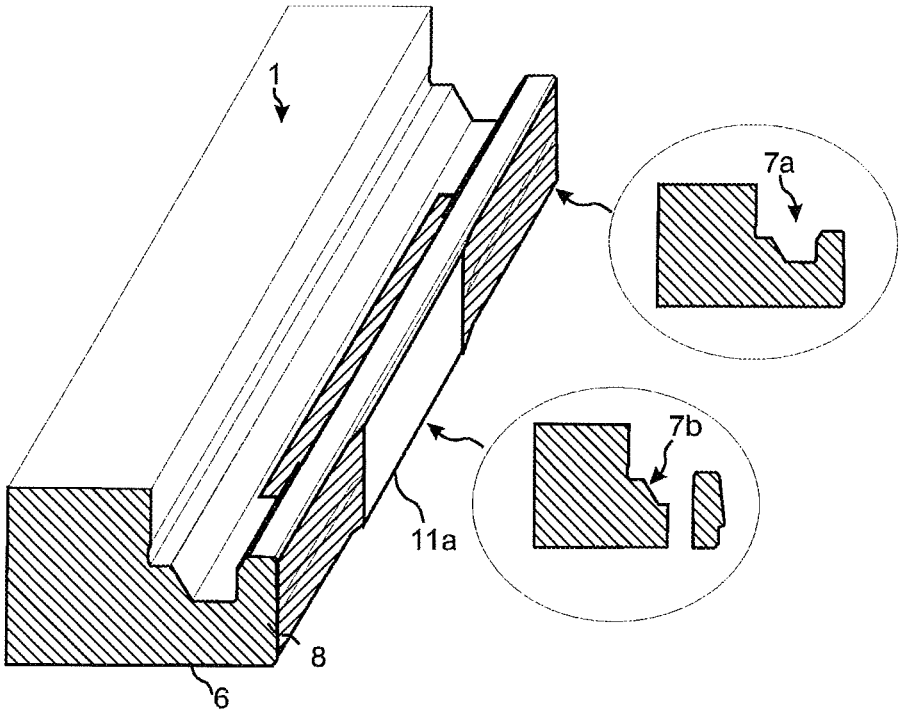

FIGS. 27*a* and 27*b* show that all embodiments of the invention disclosed in the above may be used to lock for example furniture components where a second panel 1' comprising a locking groove 14 is locked vertically and perpendicularly to a first panel 1 comprising a strip 6 and with a locking element 8. The locking groove 8 is configured to engage with the locking groove 14 in a locked position of the panels 1, 1'. The panels 1, 1' may have a first rigid edge section 7*a* providing horizontal locking of the panels 1, 1' and a second flexible edge section 7*b* comprising a slit 20 and upper 11*a* and lower 11*b* locking surfaces as described in the embodiments above. According to the embodiment in FIGS. 27*a*-*b* there is a space S provided in the second flexible edge section 7*b* between an inner surface 8*a* of the locking element 8 and a groove wall 14*a* of the locking groove 14. In a locked position, a horizontal distance between the groove wall 14*a* and an upper part 25 of the first panel 1 is smaller than a horizontal distance between an outer surface 8*b* of the locking element 8 and the upper part 25 of the first panel 1. Stabilizing surfaces may also be formed according to the embodiments in the above-described principles. An edge of second panel 1' is preferably covered in an edge banding equipment with an edge material prior to the forming of the locking system such that the lower and outer edge 35 of the second panel is covered with an edge material. Such edges may be used in all embodiments of this disclosure but also in other locking system, which are intended to lock a second panel 1' perpendicularly to a first panel 1. It is stressed that any, or any combination, of the principles above which mainly have been described in relation to floor panels also are applicable to furniture components or furniture panels. One difference, however, is that front surfaces of the first 1 and the second 1' panels do not necessarily have to be flush or aligned with each other in a locked position of the panels 1, 1', as preferably is the case in the case of floor panels. Rather, in the case of furniture components, outer surfaces 52, 52' as well as inner surfaces 53, 53' of the panels 1, 1' are preferably arranged perpendicularly to each other in a locked position. In a non-limiting embodiment, a first and a second pair of furniture components are configured to be locked to each other by means of a locking system according to any or any combination of the principles of the invention. The furniture components of each pair may be parallel to each other. The first and the second pair may be arranged perpendicularly to each other in a locked position of the panels. It is equally conceivable, however, that according to alternative embodiments, the first and the second pair are arranged at an angle to each other in a locked position.

Figure 28A:
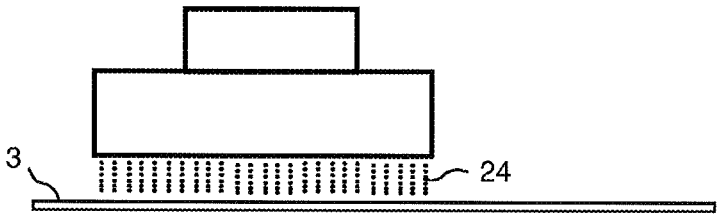
FIGS. 28*a-d* illustrate a method to strengthen edge portions according to an embodiment.
Figure 28B:
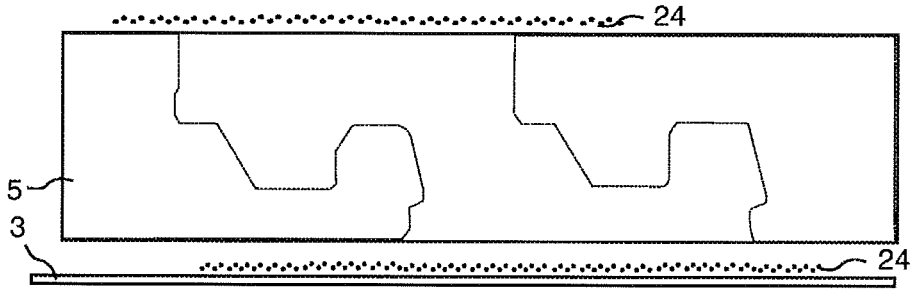
Figure 28C:
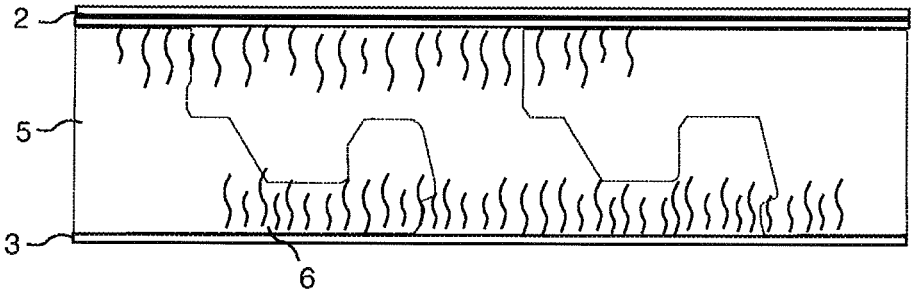
Figure 28D:
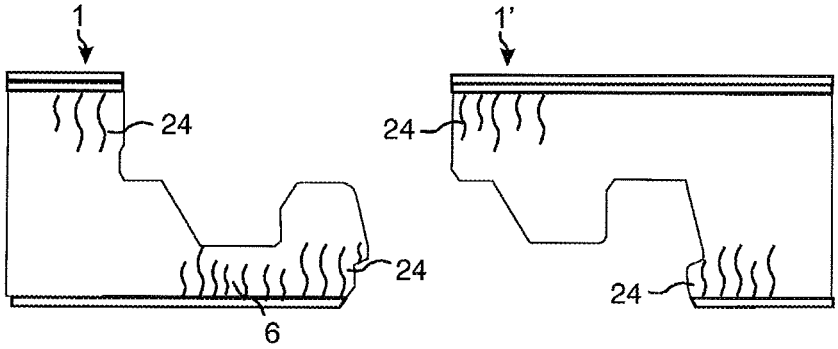

FIGS. 28*a*-28*d* show that a core material 5 of a panel 1 may be locally modified such that it becomes more suitable to form flexible and strong edges portions of a locking system. FIG. 28*a* shows that a resin, for example a thermosetting resin 24 such as for example melamine formaldehyde, urea formaldehyde or phenol formaldehyde resin, may be applied in liquid or dry powder form on for example a melamine formaldehyde impregnated balancing paper 3 or directly on a core material 5. The resin may also be locally injected into the core with high pressure. The resin may also be applied on the upper part of the core 5 in order to improve moisture properties of the upper edges. FIG. 28*b* shows that a core material 5, preferably a wood based panel for example a HDF board or a particle board, may be applied on the impregnated paper 3 with the added resin 24 prior to lamination. Alternatively, a powder layer may be applied on the resin 24. FIG. 28*c* shows a floor board after lamination when the surface layers 2 and the balancing layer 3 have been laminated to the core 5. The resins 24 have penetrated into the core 5 and cured during lamination under heat and pressure. FIG. 28*d* shows an edge of a first panel 1 and a second panel 1' with upper and lower parts that are locally strengthened with increased resin content. The first edge 1 comprises a strip 6 formed in one piece with the core 5. The material of the strip 6 is more flexible and comprises a higher resin content than other parts of the core 5. The increased resin content provides a material that is suitable to form a strong and flexible edge parts. A locking system according to one embodiment of the invention comprises a core 5 having a higher content of cured resins, preferably thermosetting resins, at a lower and outer part than at a lower and inner part. A locking system according to another embodiment of the invention comprises a core 5 having a higher content of cured resins, preferably thermosetting resins, at an upper and outer part than at an upper and inner part. These methods may be used also in other locking systems, preferably locking systems that comprise a horizontally protruding strip with a locking element at a lower part of a panel edge. In particular, the locking systems according to any of the principles in this disclosure may be provided with a higher content of cured resins according to the above.

The invention claimed is:

1. A set of essentially identical floor panels provided with a mechanical locking system comprising a strip extending horizontally from a lower part of a first edge of a first panel and a downwardly open locking groove formed in an adjacent second edge of a second panel, the strip comprising an upwardly protruding locking element which is configured to cooperate with the locking groove for locking the first edge and the second edge in a horizontal direction parallel to a main plane of the panels and in a vertical direction perpendicularly to the horizontal direction, wherein the locking element and the locking groove comprise an upper locking surface and a lower locking surface which are configured to lock the panels vertically, wherein the strip comprises slits located along the first edge, and a slit wall is configured to be bended horizontally inwardly towards an inner part of the first panel during locking, wherein the locking system in a locked position and along the edges comprises a first rigid edge section and a second flexible edge section comprising one of the slits, the first rigid edge section is configured such that an inner surface of the locking element of the first rigid edge section is in contact with the locking groove and configured such that there is a first space between an outer surface of the locking element of the first rigid edge section and an inner groove wall of the locking groove, the locking element and the locking groove being free of a vertical lock with one another at a portion along the first rigid edge section, and the second flexible edge section is configured such that there is a second space between an inner surface of the locking element and an outer groove wall of the locking groove.

2. The set as claimed in claimed in claim 1, wherein a cross section of the locking groove or a cross section of the locking element varies along the first and the second edge.

3. The set as claimed in claim 1, wherein the slit wall is further configured to be bended at least partly back to an initial position of the slit wall during a final stage of the locking.

4. A set of essentially identical floor panels provided with a mechanical locking system comprising a strip extending horizontally from a lower part of a first edge of a first panel and a downwardly open locking groove formed in an adjacent second edge of a second panel, the strip comprising an upwardly protruding locking element which is configured to cooperate with the locking groove for locking the first edge and the second edge in a horizontal direction parallel to a main plane of the panels and in a vertical direction perpendicularly to the horizontal direction, wherein the locking element and the locking groove comprise an upper locking surface and a lower locking surface which are configured to lock the panels vertically, wherein the strip comprises slits located along the first edge, and a slit wall is configured to be bended horizontally inwardly towards an inner part of the first panel during locking, wherein the locking system in a locked position and along the edges comprises a first rigid edge section and a second flexible edge section comprising one of the slits, the first rigid edge section is configured such that an inner surface of the locking element of the first rigid edge section is in contact with the locking groove and configured such that there is a first space between an outer surface of the locking element of the first rigid edge section and an inner groove wall of the locking groove, the second flexible edge section is configured such that there is a second space between an inner surface of the locking element and an outer groove wall of the locking groove, and the edge of the first panel comprises upper and lower stabilizing surfaces that in the locked position overlap each other and prevent an upward bending of the slit wall.

5. The set as claimed in claim 1, wherein the first edge and the second edge are locked with vertical pretension between upper and lower support surfaces and between the upper and lower locking surfaces.

6. A set of essentially identical floor panels provided with a mechanical locking system comprising a strip formed in one piece with a core of a first panel and extending horizontally from a lower part of a first edge of the first panel and a downwardly open locking groove formed in an adjacent second edge of a second panel, the strip comprising a strip body and an upwardly protruding locking element which upwardly protrudes from the strip body and is configured to cooperate with the locking groove for locking the first edge and the second edge in a horizontal direction parallel to a main plane of the panels and in a vertical direction perpendicularly to the horizontal direction, wherein the locking element and the locking groove comprise an upper locking surface and a lower locking surface which are configured to lock the panels vertically, wherein the strip comprises slits located along the first edge, and a slit wall is configured to be bended horizontally inwardly towards an inner part of the first panel during locking, wherein the core has a higher content of cured resins at a lower and outer part than at a lower and inner part, wherein the strip body has a higher content of cured resins than the upwardly protruding locking element.

7. The set as claimed in claim 6, wherein the resin is a thermosetting resin.

8. A set of essentially identical floor panels provided with a mechanical locking system comprising a strip extending horizontally from a lower part of a first edge of a first panel and a downwardly open locking groove formed in an adjacent second edge of a second panel, the strip comprising an upwardly protruding locking element which is configured to cooperate with the locking groove for locking the first edge and the second edge in a horizontal direction parallel to a main plane of the panels and in a vertical direction perpendicularly to the horizontal direction, wherein the locking element and the locking groove comprise an upper locking surface and a lower locking surface which are configured to lock the panels vertically, wherein the strip comprises slits located along the first edge, and a slit wall is configured to be bended horizontally inwardly towards an inner part of the first panel during locking, wherein the locking system in a locked position and along the edges comprises a first rigid edge section and a second flexible edge section comprising one of the slits, the first rigid edge section is configured such that an inner surface of the locking element of the first rigid edge section is in contact with the locking groove and configured such that there is a first space between an outer surface of the locking element of the first rigid edge section and an inner groove wall of the locking groove, the locking groove being free of contact with an outer surface of the first panel, the outer surface of the first panel including the outer surface of the locking element and extending to a bottom of the first panel, and the second flexible edge section is configured such that there is a second space between an inner surface of the locking element and an outer groove wall of the locking groove.

* * * * *